US011338946B2

(12) United States Patent
Auffray et al.

(10) Patent No.: US 11,338,946 B2
(45) Date of Patent: May 24, 2022

(54) MACHINE FOR PACKAGING WITH AT LEAST ONE STERILIZATION PACKAGING MATERIAL

(71) Applicant: STERIMED SAS, Amelie-les-Bains-Palalda (FR)

(72) Inventors: Clémentine Auffray, Le Boulou (FR); Christophe Simon, Maureillas las Illas (FR); Laurent Lebrette, Tresserre (FR)

(73) Assignee: STERIMED SAS, Amelie-les-Bains-Palalda (FR)

( * ) Notice: Subject to any disclaimer, the term of this patent is extended or adjusted under 35 U.S.C. 154(b) by 57 days.

(21) Appl. No.: 16/955,017

(22) PCT Filed: Dec. 17, 2018

(86) PCT No.: PCT/EP2018/085319
§ 371 (c)(1),
(2) Date: Jun. 17, 2020

(87) PCT Pub. No.: WO2019/121571
PCT Pub. Date: Jun. 27, 2019

(65) Prior Publication Data

US 2020/0391890 A1 Dec. 17, 2020

(30) Foreign Application Priority Data

Dec. 18, 2017 (FR) ..... 1762381

(51) Int. Cl.
*B65B 11/04* (2006.01)
*B65B 11/48* (2006.01)
(Continued)

(52) U.S. Cl.
CPC ..... *B65B 11/045* (2013.01); *B65B 11/48* (2013.01); *B65B 11/58* (2013.01); *B65B 49/08* (2013.01);
(Continued)

(58) Field of Classification Search
CPC ..... B65B 51/06; B65B 49/08; B65B 11/045; B65B 11/48; B65B 11/58; B65B 2220/16; B65B 61/26; B65B 61/06; B65B 55/00
See application file for complete search history.

(56) References Cited

U.S. PATENT DOCUMENTS 5,502,954 A * 4/1996 Akiyama ..... B65B 11/22 53/230
5,873,214 A * 2/1999 Moore ..... B65B 11/025 53/399
(Continued)

FOREIGN PATENT DOCUMENTS

EP 0 707 460 A1 4/1996
EP 1 281 617 A1 2/2003
(Continued)

OTHER PUBLICATIONS

International Search Report from the European Patent Office in International Application No. PCT/EP2018/085319 dated Feb. 11, 2019.

*Primary Examiner* — Thomas M Wittenschlaeger
(74) *Attorney, Agent, or Firm* — The Marbury Law Group, PLLC

(57) ABSTRACT

A machine for packaging an object with a sterilization packaging material the machine comprising: a plate configured to receive the sterilization packaging material and the object to be packaged placed on top, a gripping tool configured to grasp hold of a corner of the sterilization packaging material The gripping tool and the plate being are able to move relative to one another so as to allow the gripping tool to bring the corner over the top of the object and thus form a fold covering the object.

28 Claims, 35 Drawing Sheets

Figure 1A:
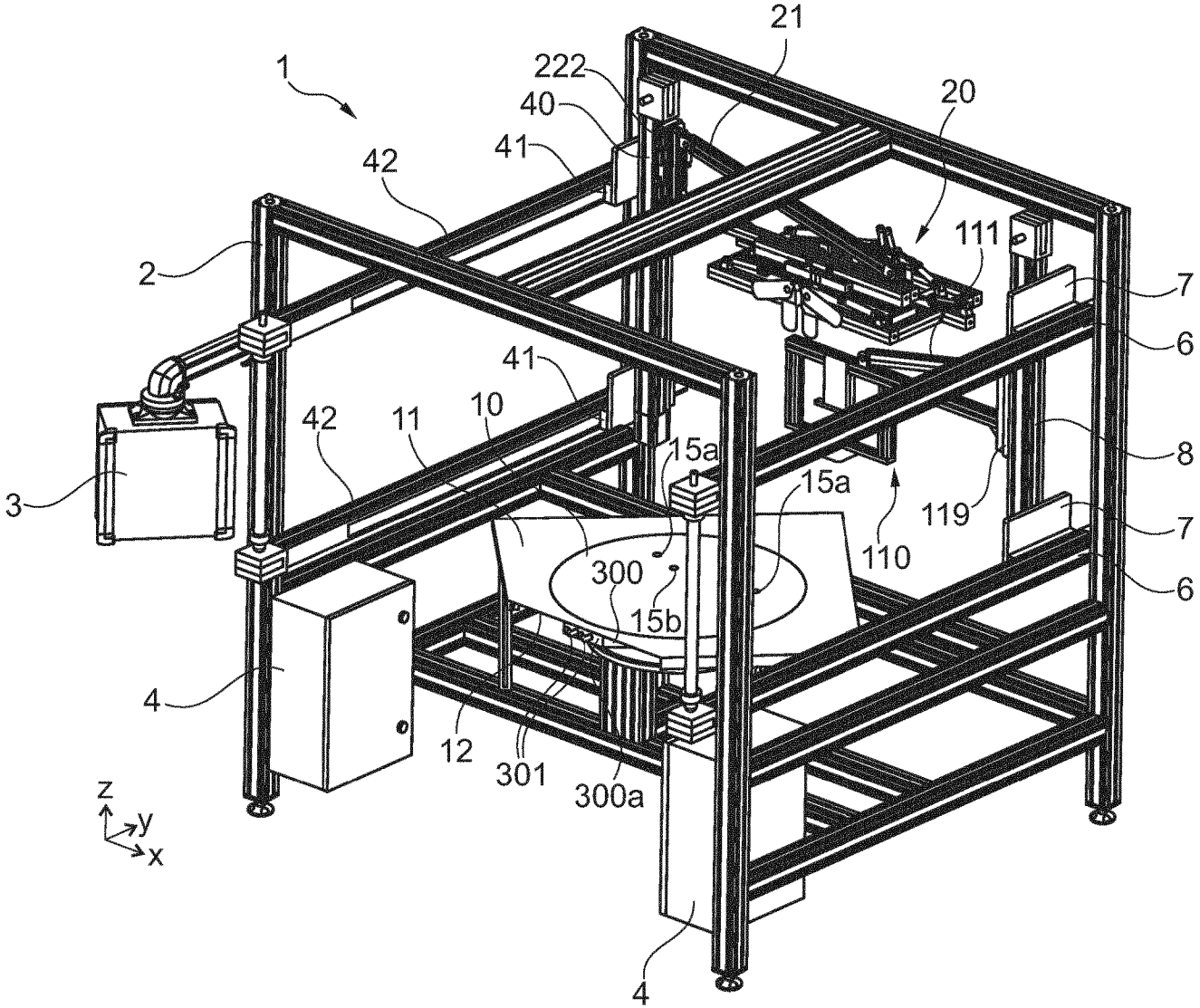

(51) Int. Cl.

| | |
|---|---|
| ***B65B 11/58*** | (2006.01) |
| ***B65B 49/08*** | (2006.01) |
| ***B65B 51/06*** | (2006.01) |
| ***B65B 55/00*** | (2006.01) |
| ***B65B 61/06*** | (2006.01) |
| ***B65B 61/26*** | (2006.01) |

(52) U.S. Cl.
CPC ..... *B65B 51/06* (2013.01); *B65B 55/00* (2013.01); *B65B 61/06* (2013.01); *B65B 61/26* (2013.01); *B65B 2220/16* (2013.01)

(56) References Cited

U.S. PATENT DOCUMENTS

| | | | | |
|---|---|---|---|---|
| 8,562,274 | B2 * | 10/2013 | Murray | B65B 39/02 414/222.02 |
| 2019/0382220 | A1 * | 12/2019 | Boudreau | B65G 57/24 |
| 2020/0237472 | A1 * | 7/2020 | Van Der Vliet | A61B 50/3001 |

FOREIGN PATENT DOCUMENTS

| | | | |
|---|---|---|---|
| EP | 1 362 557 | A1 | 11/2003 |
| EP | 1 717 149 | A1 | 11/2006 |
| GB | 953 551 | A | 3/1964 |
| WO | 2019/009724 | A1 | 1/2019 |

* cited by examiner

MACHINE FOR PACKAGING WITH AT LEAST ONE STERILIZATION PACKAGING MATERIAL

CROSS REFERENCE TO RELATED APPLICATIONS

This is a national stage application of PCT/EP2018/085319, filed internationally on Dec. 17, 2018, which claims priority to French Application No. 1762381, filed on Dec. 18, 2017, both of which are incorporated by reference herein in their entireties.

The present invention relates to the packaging of sterilization baskets and more particularly to a machine for the automated or semi-automated packaging of a sterilization basket and to an associated packaging method.

Medical devices, and particularly the instruments intended to be in contact with the human body and/or used in operating units, such as surgical instruments, are generally packaged in sterilization baskets (also known as trays) which are then packaged with sterile barrier systems.

The latter may be of various types: sterilization pockets, pouches, bags, sleeves, wraps, containers or sheets.

The choice of packaging is dependent on the size of the devices, on their weight and on the risks associated with handling and transporting them.

Packaging in the form of bags or wraps are limited in terms of their capacity and are unable to accept bulky and/or heavy objects.

Given their low cost and their adaptability to suit the various baskets available, sterilization sheets are commonly used in sterilization centers. Sterilization sheets are notably particularly suited to the packaging of bulky and/or heavy objects such as sterilization baskets.

A first technique commonly used in the medical environment for packaging sterilization baskets with sterilization sheets is the so-called "Pasteur folding" technique. With this technique, a sterilization sheet is folded repeatedly to obtain a tortuosity sufficient to maintain the sterility of the contents of the packaging, without any sealing being performed.

However, if the folding is of poor quality, the sterility of the object will not be maintained over time. Indeed the maintaining of sterility is dependent on the quality of the folding.

It is known practice to wrap sterilization baskets in a double wrap, made up of two sterilization sheets, in order to improve the preservation of the sterile state. The folding operation is therefore performed sequentially, in two stages, first of all using a first sterilization sheet also referred to as the primary wrap or inner wrap, and then using a second sterilization sheet also referred to as the secondary wrap or outer wrap. The primary wrap, the purpose of which is to act as an individual sterility protector, constitutes a microorganism-impermeable barrier around the sterilization basket. The secondary wrap, which surrounds the primary wrap, is designed to protect the primary wrap and its contents as far as the point of use thereof. The secondary wrap makes it possible to avoid any damage that might befall the primary wrap and its contents, notably during handling, transport or storage operations.

This double wrap system combining microbiological protection from the primary wrap and mechanical protection from the secondary wrap improves the preservation of sterility. However, it requires a sequential folding operation, which has the disadvantage of lengthening the time that the operator takes to perform the folding operation.

Applications EP 0 707 460 A1 and EP 1 362 557 A1 disclose the possibility of wrapping sterilization baskets in a double wrap packaging, the folding operation being performed in a single step, offering a saving in terms of time and simplicity of carrying out the folding operation. The sterilization packaging is then made up of two sterilization sheets fixed together along the edges so as to be held together. The edges of the sterilization sheets may be joined to one another notably by adhesives, a stitch, or a thermal or ultrasonic bond. For example, the sterilization packaging is made up of two sterilization sheets made of SMS (Spunbond-Meltblown-Spunbond) structure polypropylene which are heat sealed to one another along the edges.

The methods for packaging baskets with sterilization sheets are still currently performed manually. The quality of the folding, and therefore the maintaining of sterility, therefore have the disadvantage of being very highly dependent on human intervention. Furthermore, the folding operation requires the operator to be trained. This folding operation is therefore costly in terms of time and in times of labor, in addition to being repetitive and tricky.

A second technique is to place the object that is to be sterilized in a peel-pouch type packaging. Once the object is inside the packaging, the packaging is sealed, then subjected to the sterilization step. The packagings are usually made up of two distinct sheets made of different materials. One of the sheets is usually transparent. The packagings are suited to the sterilization technique employed. This technique offers the advantage of not requiring a folding operation, allowing a time saving. However, because peel-pouch type packagings are made up of two heat-sealed sheets, the mechanical strength may be limited by the mechanical strength of the bond that joins the two sheets together or by the strength of the packaging itself. This technique is therefore not the first choice for packaging bulky and/or heavy sterilization baskets.

The invention seeks to improve still further the devices and methods used for packaging sterilization baskets, and notably to overcome all or some of the above disadvantages. It achieves this using a machine for packaging an object, notably a sterilization basket, with at least one sterilization packaging material, notably a sterilization sheet, the machine comprising:

- a plate configured to receive the sterilization packaging material and the object to be packaged placed on top,
- a gripping tool configured to grasp hold of a corner of the sterilization packaging material, the gripping tool and the plate being able to move relative to one another so as to allow the gripping tool to bring the corner over the top of the object and thus form at least one fold covering the object.

The machine according to the invention allows an object that may contain freshly washed and disinfected, notably reusable, medical devices to be packaged using at least one sterilization packaging material. These medical devices may be elements intended to be in contact with the human body and/or used in operating units, such as surgical gowns and/or surgical instruments, notably scalpels, forceps, scissors, endoscopes, bowls, trays or tongue-depressors.

The machine according to the invention can be used in sterilization centers, notably hospitals and healthcare establishments, and/or by the manufacturers of surgical packs.

The machine according to the invention can be used to package an object, such as a sterilization basket, whether this is a standardized basket such as a basket in accordance with the ISO 3394 or DIN 58952 standard, or a non-standardized basket.

The machine according to the invention allows the folding operation to be automated, thereby on the one hand leading to a reduction in the cost of producing a sterilization basket, notably by transferring some of the available labor to other tasks.

On the other hand, the risk of human error is reduced.

The risks of the onset of musculoskeletal disorders are also reduced.

Another advantage is that, in terms of productivity, the automated folding operation performed by the machine according to the invention is at least as rapid as a manual folding operation performed by a human operator.

The expression "sterilization packaging material" refers to any packaging material intended for sterilization, namely any packaging material which is compatible with a sterilization method, notably using EtO gas and/or steam and/or dry heat and/or low temperature steam formaldehyde sterilization (the LTFS method) and/or any other oxidative or non-oxidative sterilization method, while at the same time offering the required bacterial barrier to allow sterility to be preserved for the full duration claimed for the packaged object. The sterilization packaging material is, for example, a sterilization sheet and needs therefore to meet the general requirements described in international standard ISO 11607-1: 2006/A1: 2014: "Packaging for terminally sterilized medical devices—Part 1: Requirements for materials, sterile barrier systems and packaging systems" which in particular defines the microbial barrier properties and the compatibility with the sterilization process. The performance of sterilization sheets is also described in European standard EN 868-2: 2017: "Materials and systems for packaging for terminally sterilized medical devices—Part 2: Sterilization wrap—Requirements and test methods". The sterilization packaging material may also be a sterile drape in accordance with the ISO 13795 and/or AAMI PB 70 standards. The sterilization packaging material may also be a sterile handover drape (also known as an "inner wrap") that allows for aseptic transfer of medical devices. The sterilization packaging material may be a sterilization packaging material that may or may not have shape memory. If the sterilization packaging material is a sterilization packaging material that has shape memory, it may be based on cellulose.

As a preference, the plate and the gripping tool are designed to rotate one relative to the other. That means that just a single gripping tool can be used to perform all of the folding steps, and that therefore the machine can be of simpler construction.

As a preference, the plate is able to rotate about a vertical axis of rotation. That makes it possible to have a gripping tool, the movement of which is simpler, for example translational along several axes relative to a chassis, without rotational movement. This approach makes it possible to simplify the machine by reducing the number of axes of movement needed for moving the tools of the machine. This also makes it possible to minimize the cost of the machine.

The gripping tool may thus be able to move vertically and along at least one horizontal axis.

The gripping tool preferably comprises a pressing system comprising a shoe able to move vertically facing a bearing surface. That means that the sterilization packaging material can be held effectively, by gripping between the shoe and the bearing surface.

The gripping tool preferably has a surface onto which there opens at least one orifice selectively connected to a source of vacuum. This source of vacuum may be a depression created through a Venturi effect. When the packaging of the object is performed using several sterilization packagings, for example a double wrap performed with two sterilization sheets sequentially, that allows the sterilization sheets to be separated using a suction effect. This source of vacuum allows optimization of the gripping of the sterilization packaging material as well as allowing it to be selected unitarily.

In one exemplary embodiment, the orifice opens onto the underside face of the shoe of the gripping tool.

As a preference, the gripping tool comprises a member for pushing the sterilization packaging material under the object. That makes it possible to form a flap that holds in place a fold formed beforehand.

This member may take the form of a horizontal plate mounted at the lower end of the gripping tool, this plate tapering preferably toward its distal end. Thus, the plate may have a thin free end which makes it easier to insert between the object and the portion of the sterilization packaging material on which it is placed. As a preference, the plate comprises at least one finger able to move vertically so as to lift the object and the sterilization packaging material locally. This finger may be actuated when the aforementioned plate is used to push the sterilization packaging material under the object.

As a preference, the machine comprises a table extending around the plate. As a preference, the sterilization packaging material is larger than the plate, so that its four corners extend beyond the plate. The table is able to receive these corners of the sterilization packaging material.

As a preference, the table has at least one truncated corner. Thus, the corner of the sterilization packaging material which lies in this truncated corner does not rest on the table but overhangs beyond this truncated corner, making the plate easier for operators, when the placement and removal of the object are not automated, or for any suitable conveying system and/or automaton, to access.

The machine may comprise at least one holding and/or folding tool, the holding and/or folding tool and the plate being able to move one relative to the other, the holding and/or folding tool being designed to act on the sterilization packaging material when at least one fold has been formed along one side of the object, by using at least one smoothing-down member to smooth the sterilization packaging material down along at least one adjacent side of the object, near the side along which the fold has been formed and around which the next fold is to be made. Such a holding and/or folding tool makes it easier to make the other three folds after the first one, by ensuring that the fold formed beforehand is brought over toward the inside and smoothed snuggly against the object at the moment of forming the next one.

As a preference, the holding and/or folding tool comprises a pushing member, able to move toward the inside in order to push inward a portion of the sterilization packaging material that extends along the fold already formed, facing the portion of the sterilization packaging material that has already been smoothed down against the object.

The smoothing-down member may take the form of a vertical fixed plate, and the pushing member the form of a vertical plate, able to move about a horizontal axis of rotation, preferably between a raised position and a lowered position in which it is superposed at least partially with the fixed plate. The holding and/or folding tool, notably with its smoothing-down member and/or its pushing member, makes it possible to overcome the customary problems of shape-memory sterilization packaging materials such as sterilization packaging materials based on cellulose, notably crepe papers, reinforced papers and/or cellulose-based nonwovens.

As a preference, the machine comprises at least two grippers making it possible to grasp hold of at least one portion of the packaging between them and lift it so as to allow a corner of the sterilization packaging material to be pushed under the portion or portions thus lifted. This or these portions of packaging may be formed of one or more thicknesses of the sterilization packaging material which are covering the object as a result of earlier folding operations.

The two grippers may be mounted in such a way as to be able to move away from one another and keep the grasped portion or portions taut. That makes it easier to tuck a portion of the sterilization packaging material under the portion or portions thus held taut and lifted up. As a preference, the grippers are mounted with the ability to pivot on the holding and/or folding tool.

As a preference, the machine comprises an object holding system comprising at least two mobile lateral holding members, between which the object can be held laterally. This holding system may notably be of benefit when the last flap needs to be formed.

The lateral holding members may be formed by two pivoting panels which are mounted on the folding and/or holding tool.

Thus, the latter may bear several members implemented at different stages, thereby allowing the mechanism for driving them relative to the chassis to be shared between all of these members, thus simplifying the machine and optimizing its cost.

In one exemplary embodiment of the invention, the holding and/or folding tool comprises two lateral parts each comprising a U-shaped frame, with a front profile section bearing one of the pushing members and a rear profile section bearing one of the grippers.

Each lateral part may comprise an intermediate profile section, each of the panels being articulated between this intermediate profile section and the rear profile section.

The machine may comprise a system for verifying the positioning of the object with respect to the sterilization packaging material and/or a system for verifying the positioning of the sterilization packaging material with respect to the plate. This or these verification systems are, for example, optical, and rely on the processing of images from one or more cameras.

The machine may comprise a system for verifying the conformity of the composition of the contents of the object before and/or after packaging. This verification system is, for example, optical, being performed notably by laser analysis, or by weighing the object, or any other verification system.

The machine may comprise a system for labeling and/or marking the object before and/or after packaging, notably providing traceability thereof, his labeling and/or marking system is, for example, of the laser or ink-jet printing type.

The machine may comprise a system for recording, storing and managing data providing traceability of the operations performed by the machine.

The machine may comprise a connection with a computerized data management system.

As a preference, the machine comprises a system for validating the closure of the sterilization packaging wrapping the object, and notably a system for validating the closure of a surgical pack. This makes it possible to obtain repeatable and reproducible closures that meet the international validation standards ISO 11607-2: 2016.

The machine may comprise a system for closing the packaging with at least one adhesive tape that may or may not contain at least one sterilization indicator. The closure system meets the requirements of standard ISO 11607-1 which notably defines a closure system with tamperproofing device. The closure system remains operational as far as the point of use.

The machine may comprise at least one reel for unrolling a roll of adhesive tape which may or may not contain at least one sterilization indicator, and a cutting device for cutting this tape in order to close the package.

The machine may comprise at least one reel for unrolling a roll of a sterilization packaging material and a cutting device for cutting this sterilization packaging material. The machine may, notably in this case, comprise a system for automatically measuring the dimension of the object and adapting the dimension of the sterilization packaging material accordingly.

As an alternative, the sterilization packaging materials are precut and present for example in a stack next to the machine.

The machine may comprise a system for placing the sterilization packaging material on the plate and/or a system for placing the object on the sterilization packaging material.

The machine may comprise a system for recovering the object once it has been packaged.

Another subject of the invention is an assembly comprising a machine according to the invention, as defined hereinabove, at least one object to be packaged preferably a sterilization basket, and at least one sterilization packaging material, preferably a sterilization sheet, for packaging the object.

A further subject of the invention is a method for packaging an object, preferably a sterilization basket, with at least one sterilization packaging material, preferably a sterilization sheet, the packaging being performed using a machine according to the invention, as defined above.

In particular, during the course of this method, at least four folds can be formed by successively grasping hold of one corner of the sterilization packaging material using the gripping tool and by bringing the sterilization packaging material, via this corner, over the object.

Advantageously, between two folds, the sterilization packaging material with the object on top is turned relative to the gripping tool, preferably by rotating the plate, notably by 90°.

After the first fold is formed, the first corner that was grasped in order to make this first fold may be pushed under the object.

As a preference, in order to form the next folds, the sterilization packaging material is held against the object and a fold previously formed is pushed laterally inward.

Also as a preference, after the last fold has been formed, at least one portion of the sterilization packaging material, which portion is situated on the top of the object and formed during an earlier fold, is grasped, and the last fold is tucked under this or these portions. In order to form this tucked flap, said portion or portions is or are preferably held taut between two grippers, and lifted up slightly.

The sterilization packaging material can be pushed under this or these portions using the same member as was used to form the first tucked flap by pushing the first corner under the object. During this operation, the holding and/or folding tool can be used both to grasp hold of said portion or portions using the grippers and to immobilize the object laterally between the aforementioned lateral holding members.

As a preference, the machine is thus used to create folds of the Pasteur type. This type of folding makes it possible to reduce the size of the machine and the area of sterilization packaging materials used. In this way, the space occupied by the machine is reduced and the area of sterilization packaging materials used is optimized, this notably making it possible to reduce the quantity of waste produced. Furthermore, the Pasteur-type folding is recognized by the various standards concerned with sterilization.

The packaging can be performed using one or, better, two sterilization packaging materials.

In that case, packaging is done for example sequentially, packaging the object a first time using a first sterilization packaging material, and then packaging the object thus packaged a second time using a second sterilization packaging material.

The procedure can even be performed in a single operation using sterilization packaging materials joined together at one or more connection sites.

The packaging may be performed using two sterilization packaging materials, it being possible for these two sterilization packaging materials to be joined together at one or more connection sites and it being possible for the packaging to be performed with the two sterilization packaging materials simultaneously.

Figure 1B:
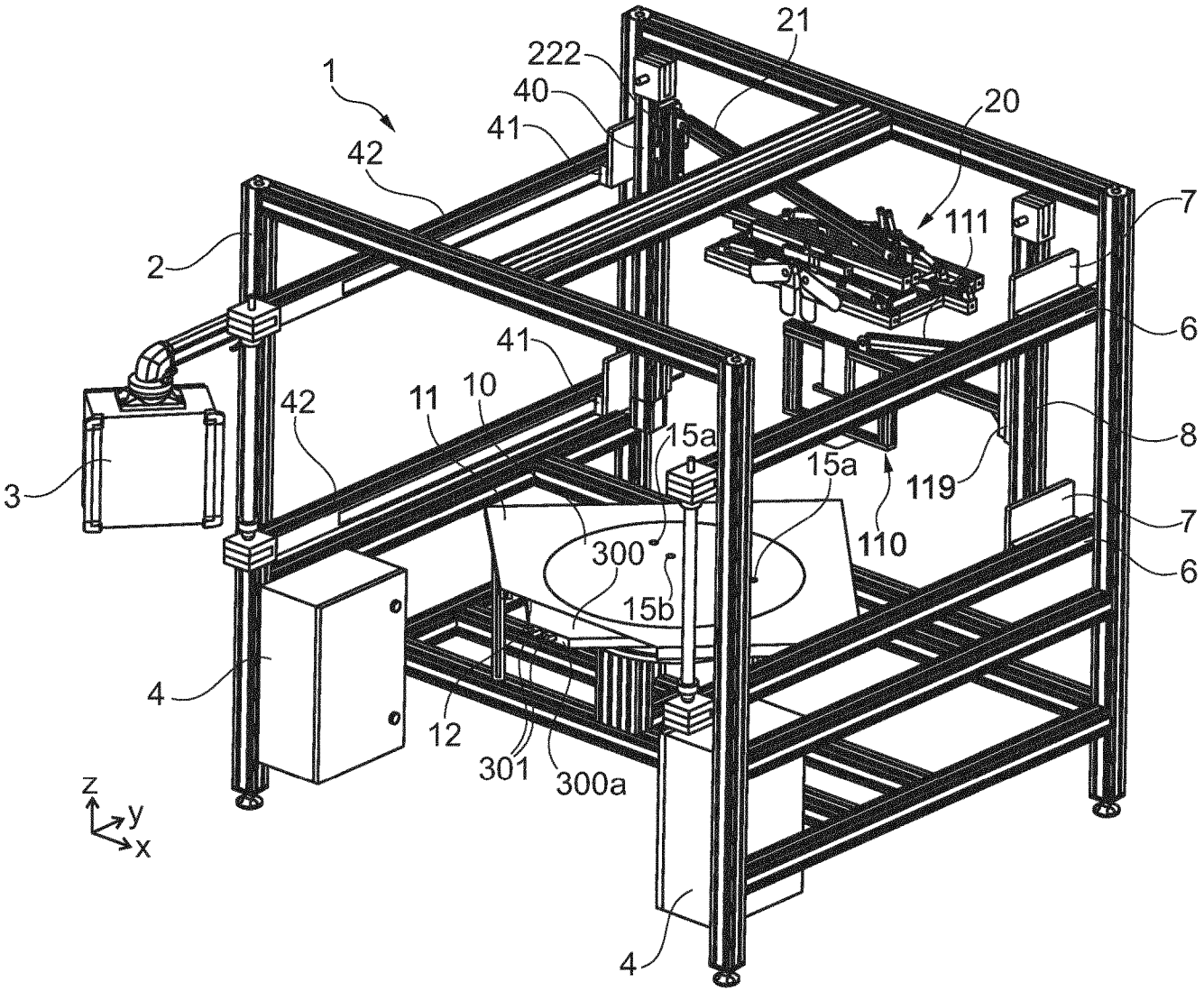
Figure 1C:
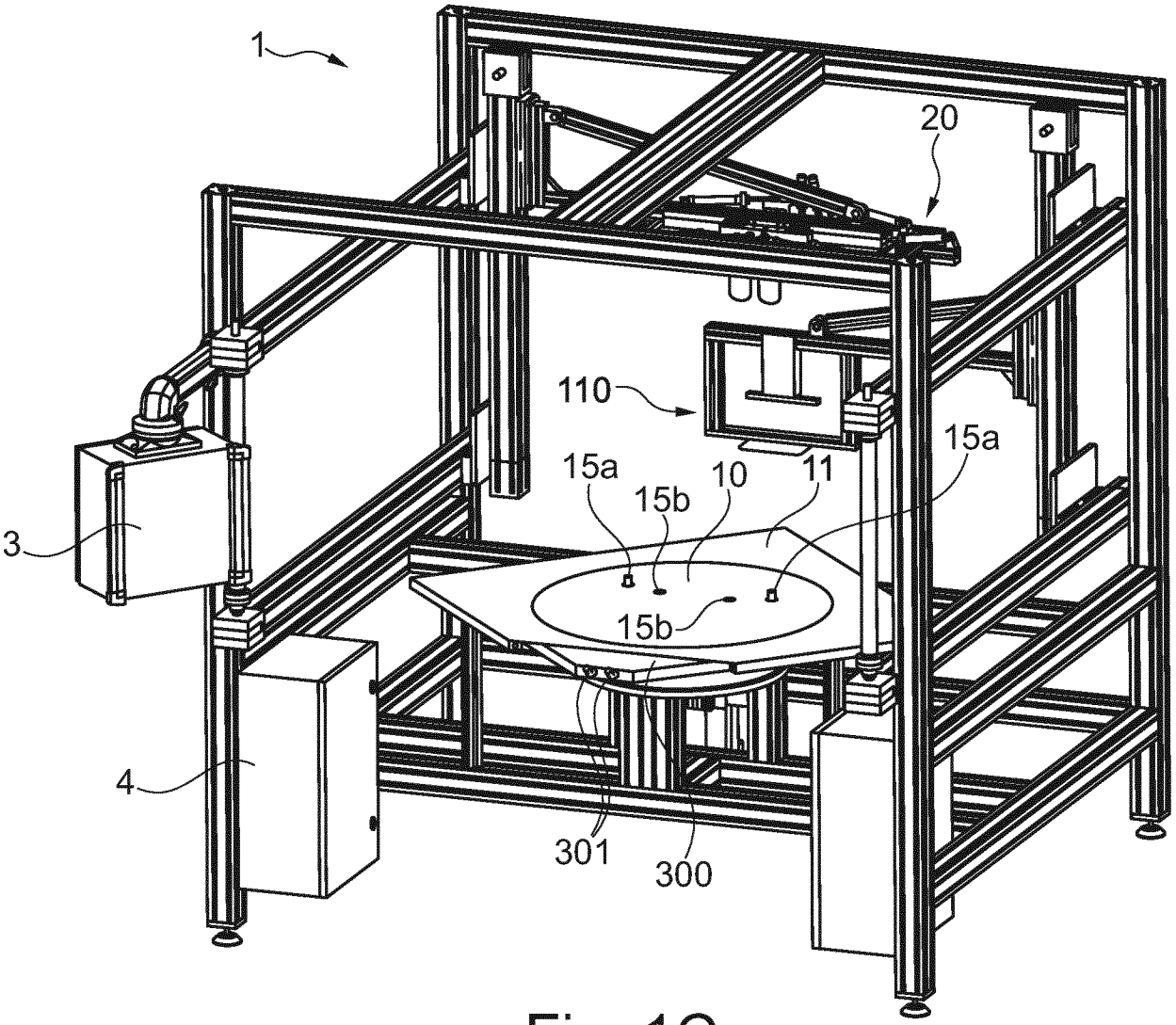
Figure 1D:
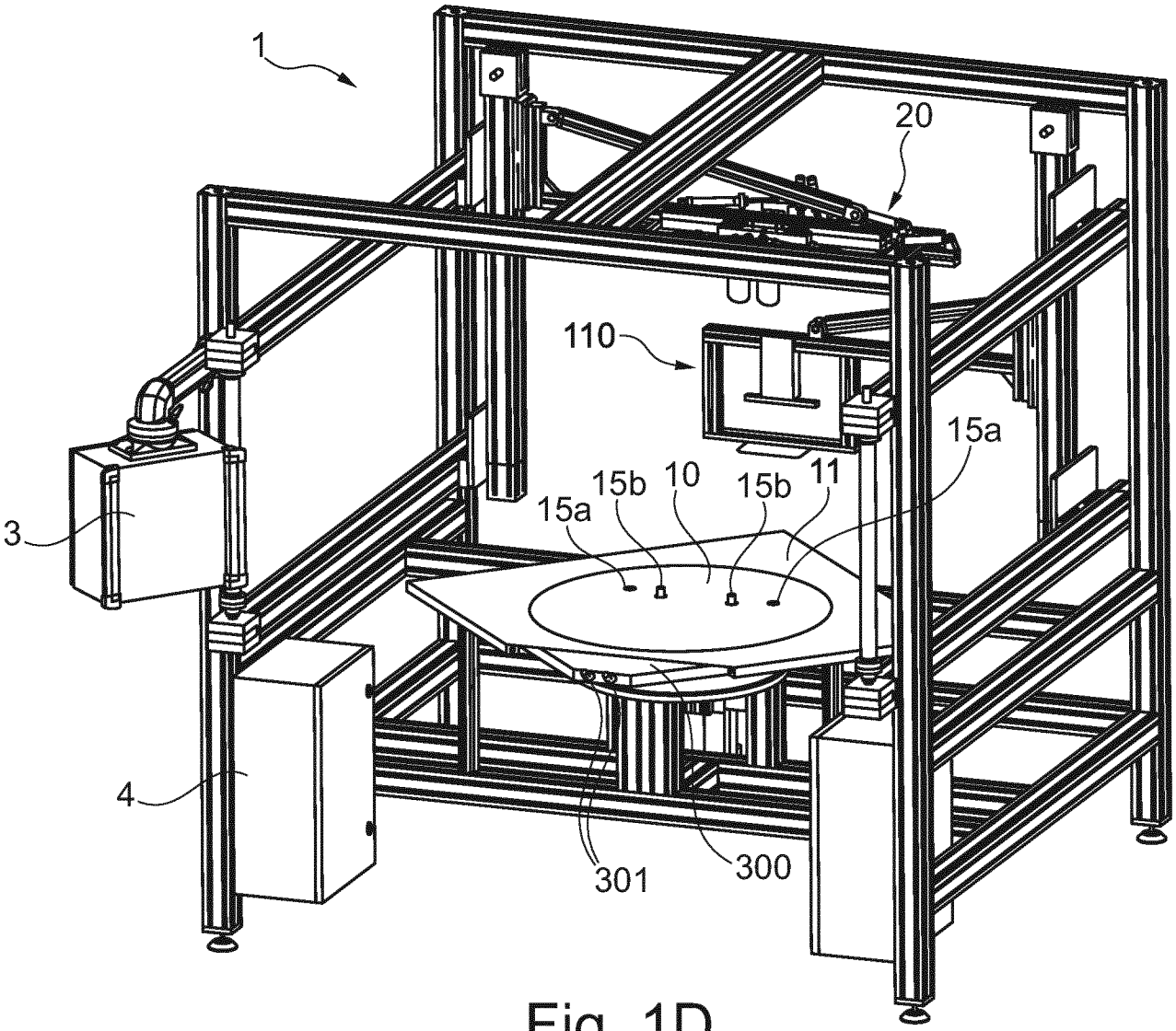
Figure 2:
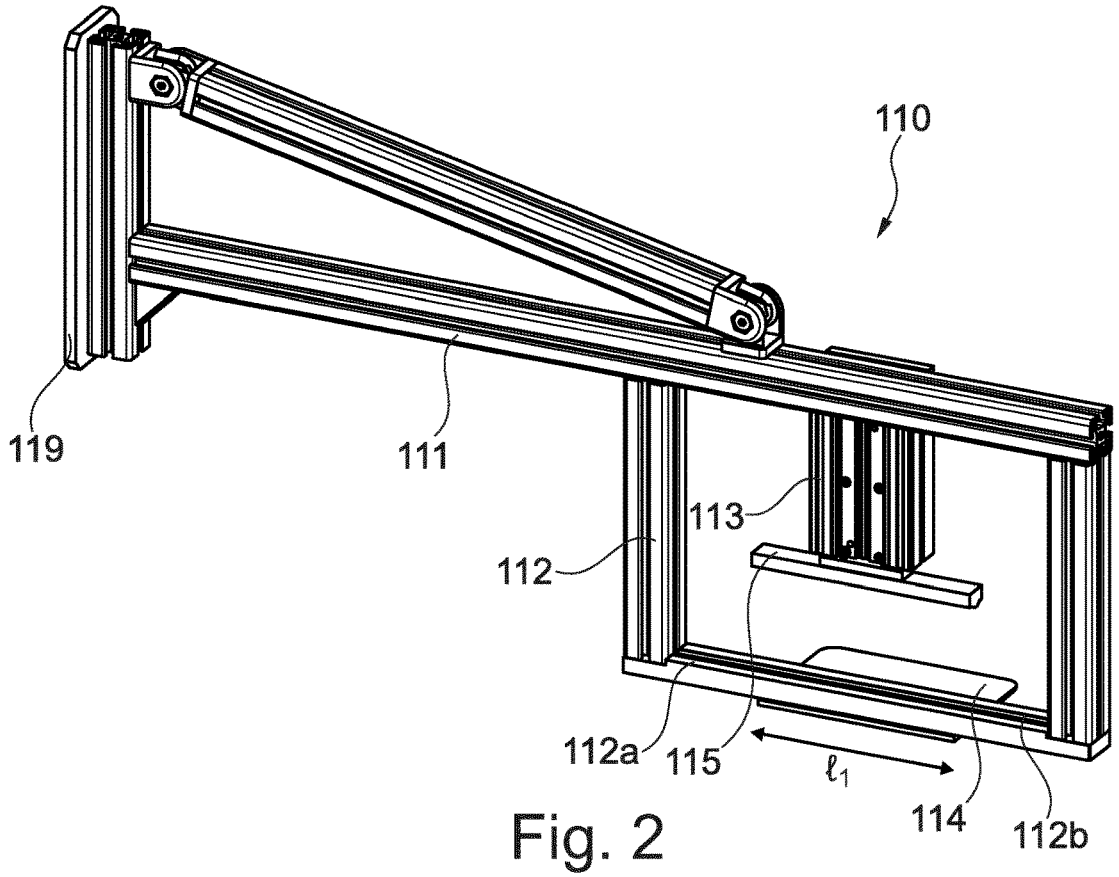
Figure 3:
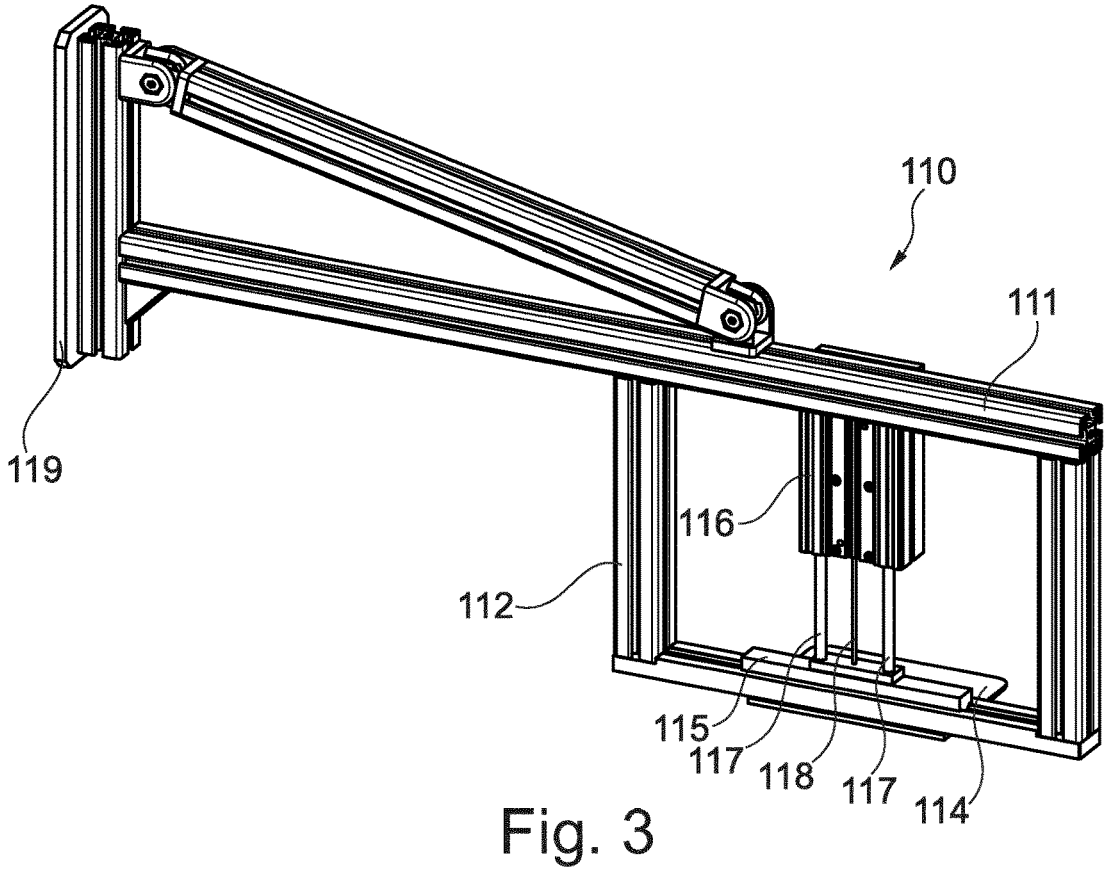
Figure 4:
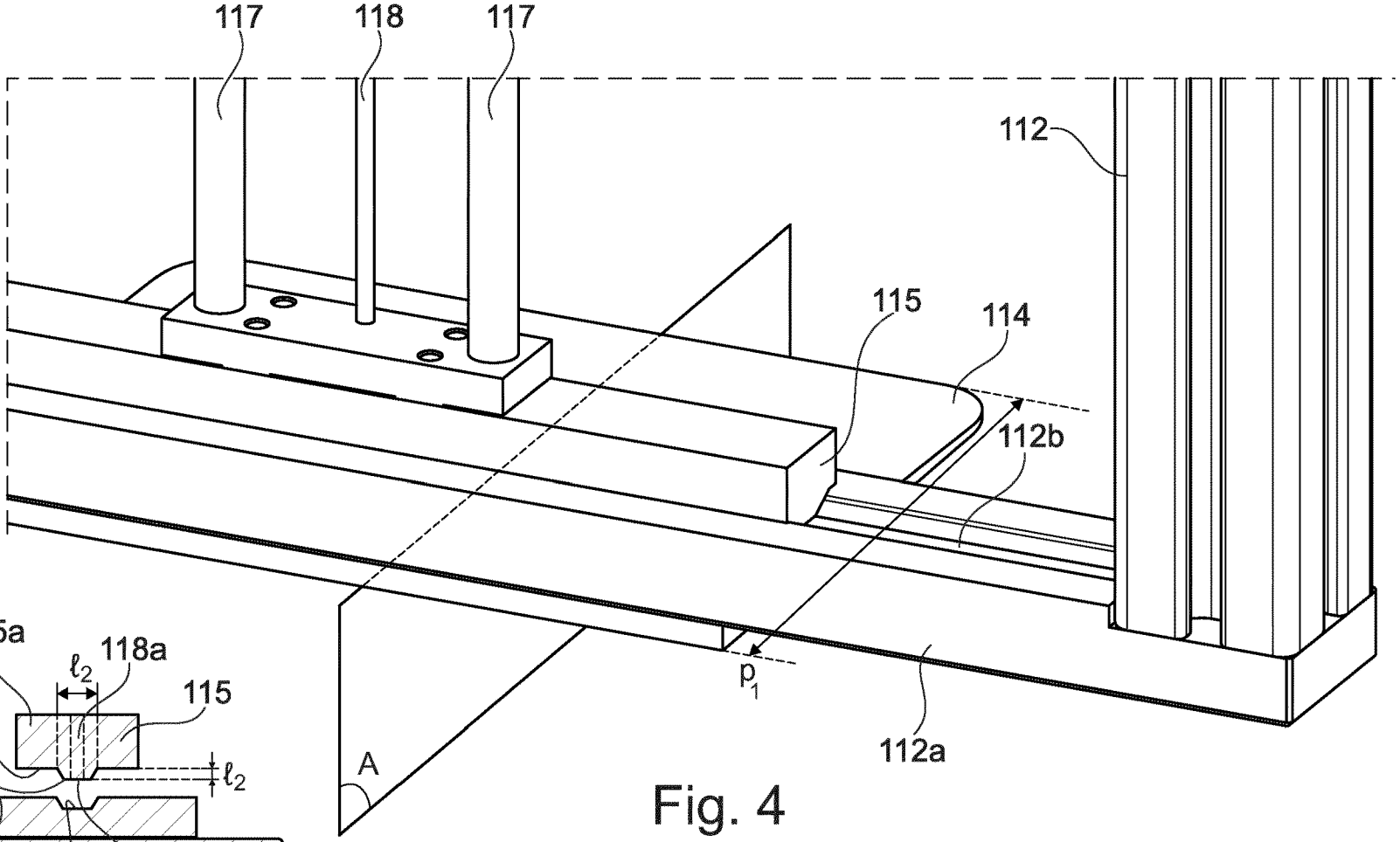
Figure 4A:
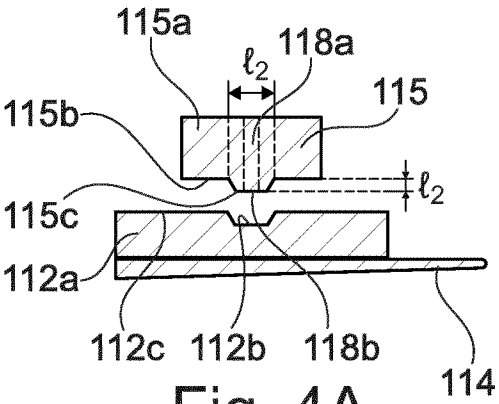
Figure 5:
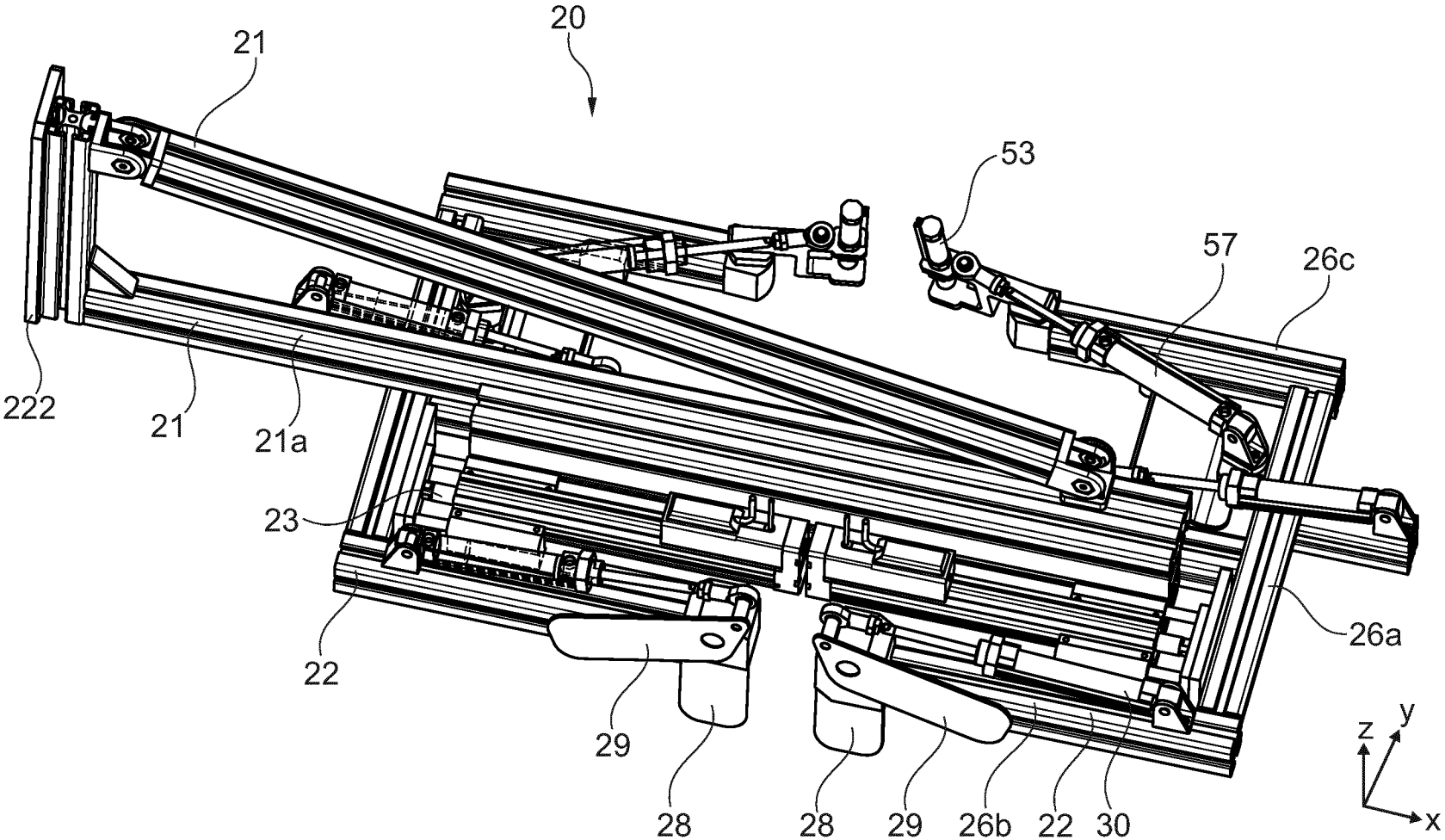
Figure 8:
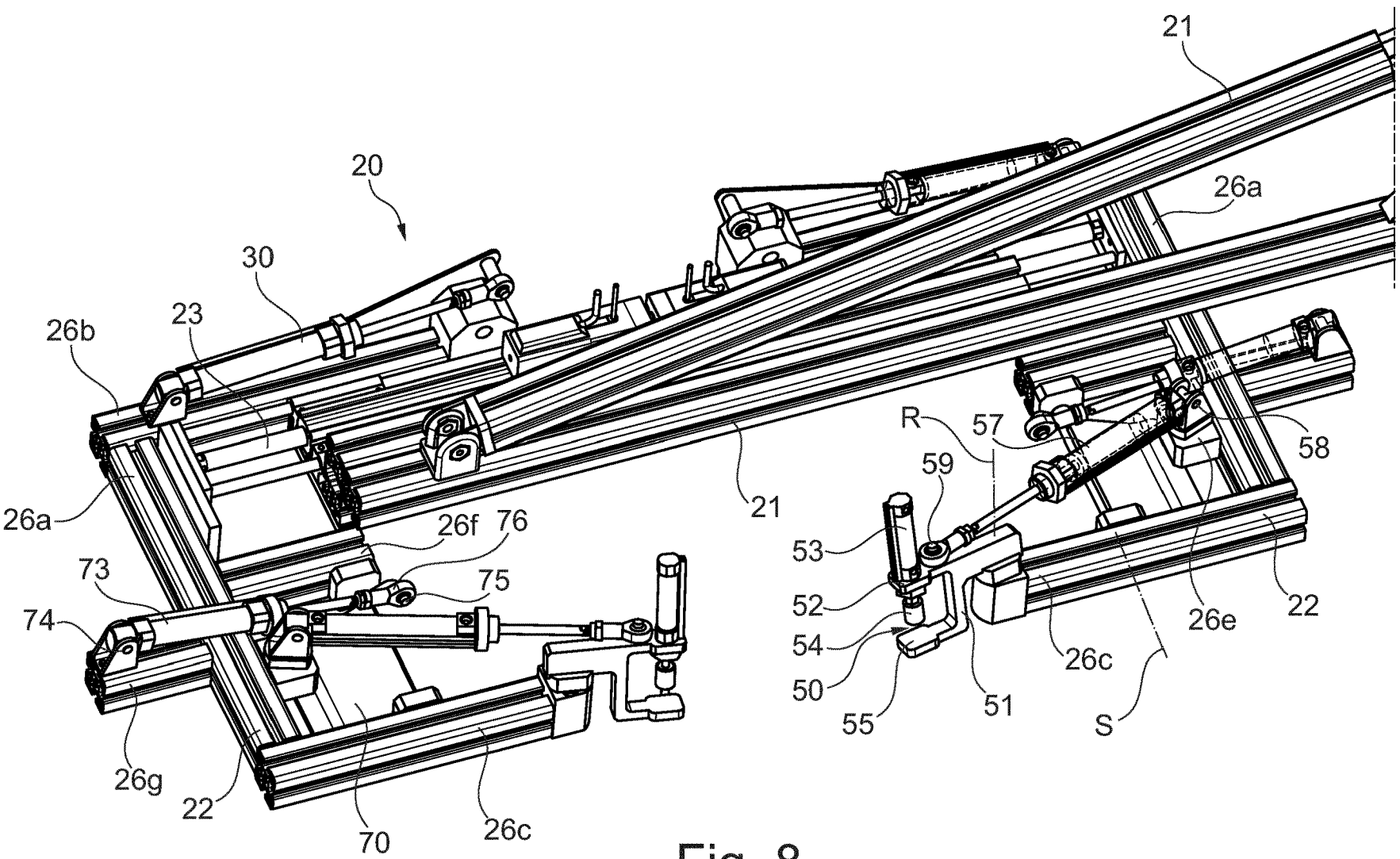
Figure 9:
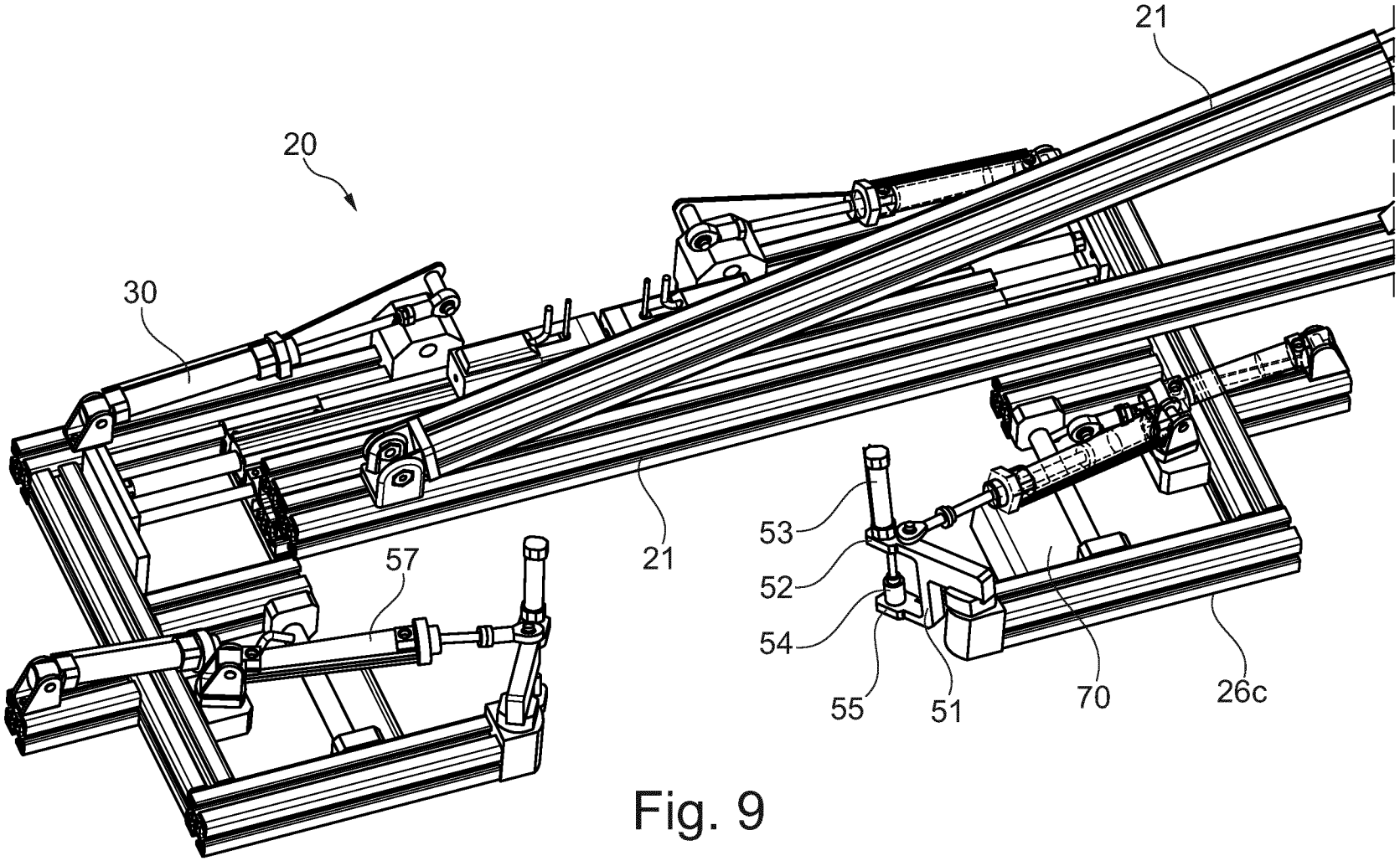
Figure 10A:
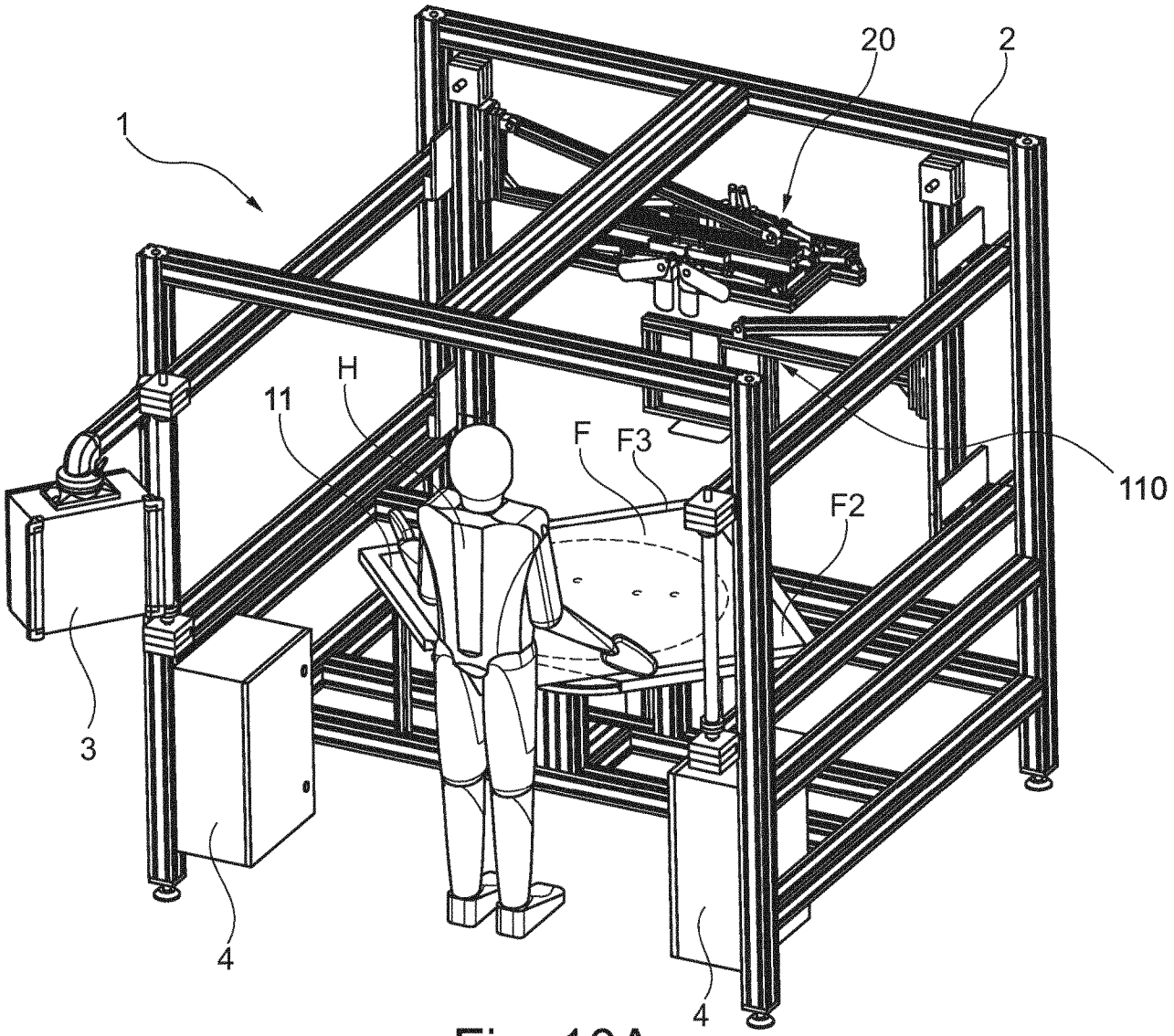
Figure 10B:
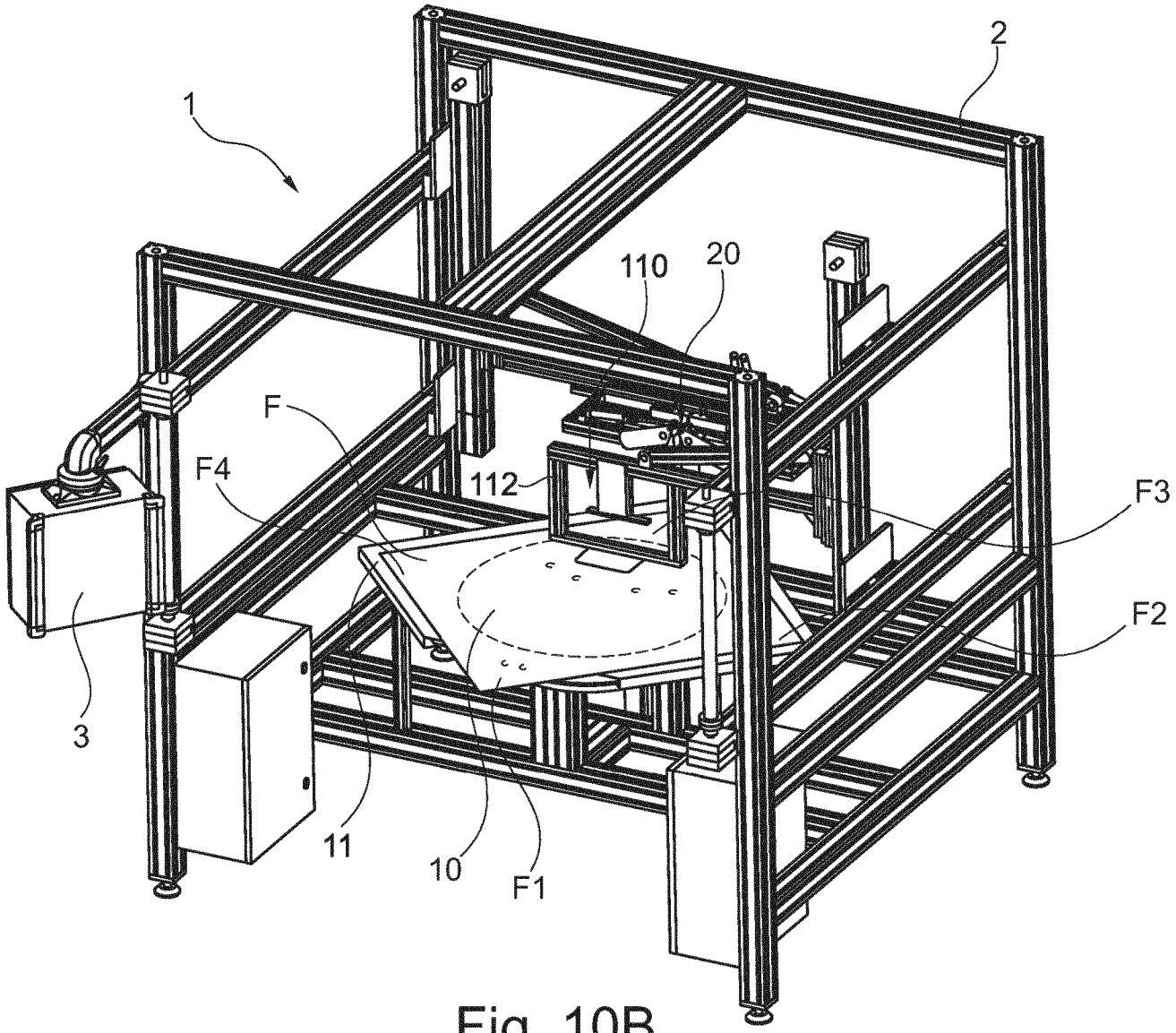
Figure 10C:
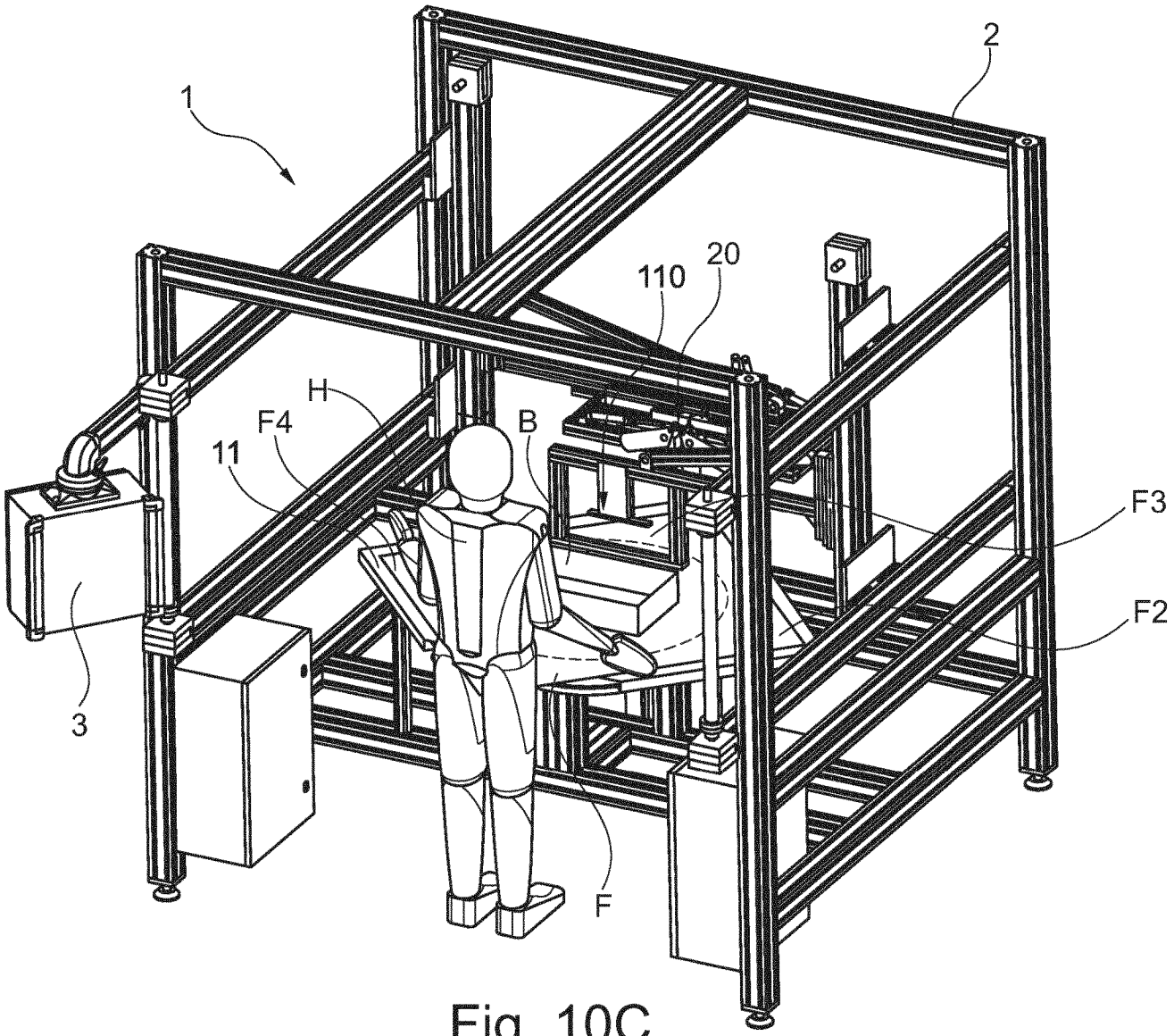
Figure 10D:
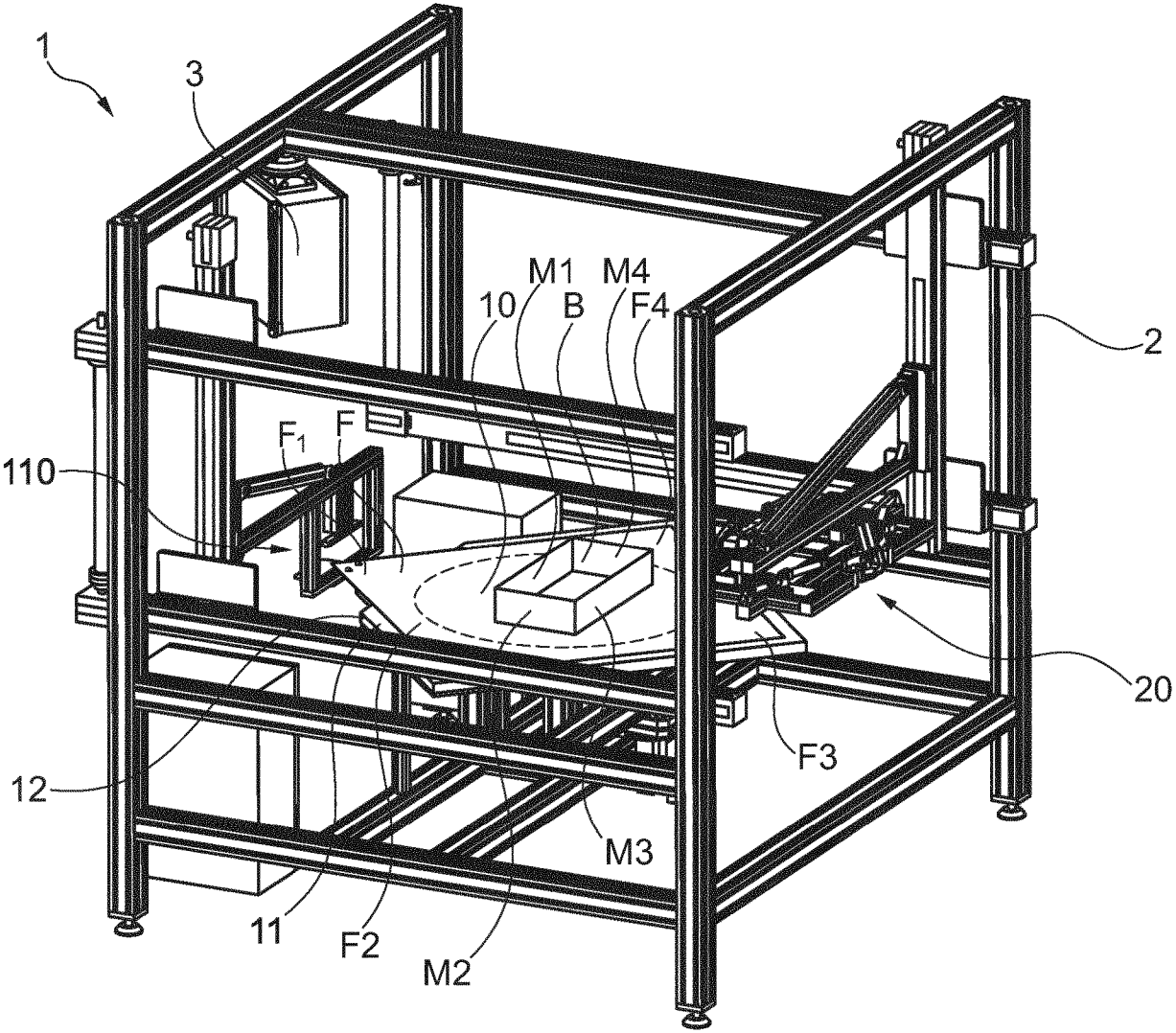
Figure 10E:
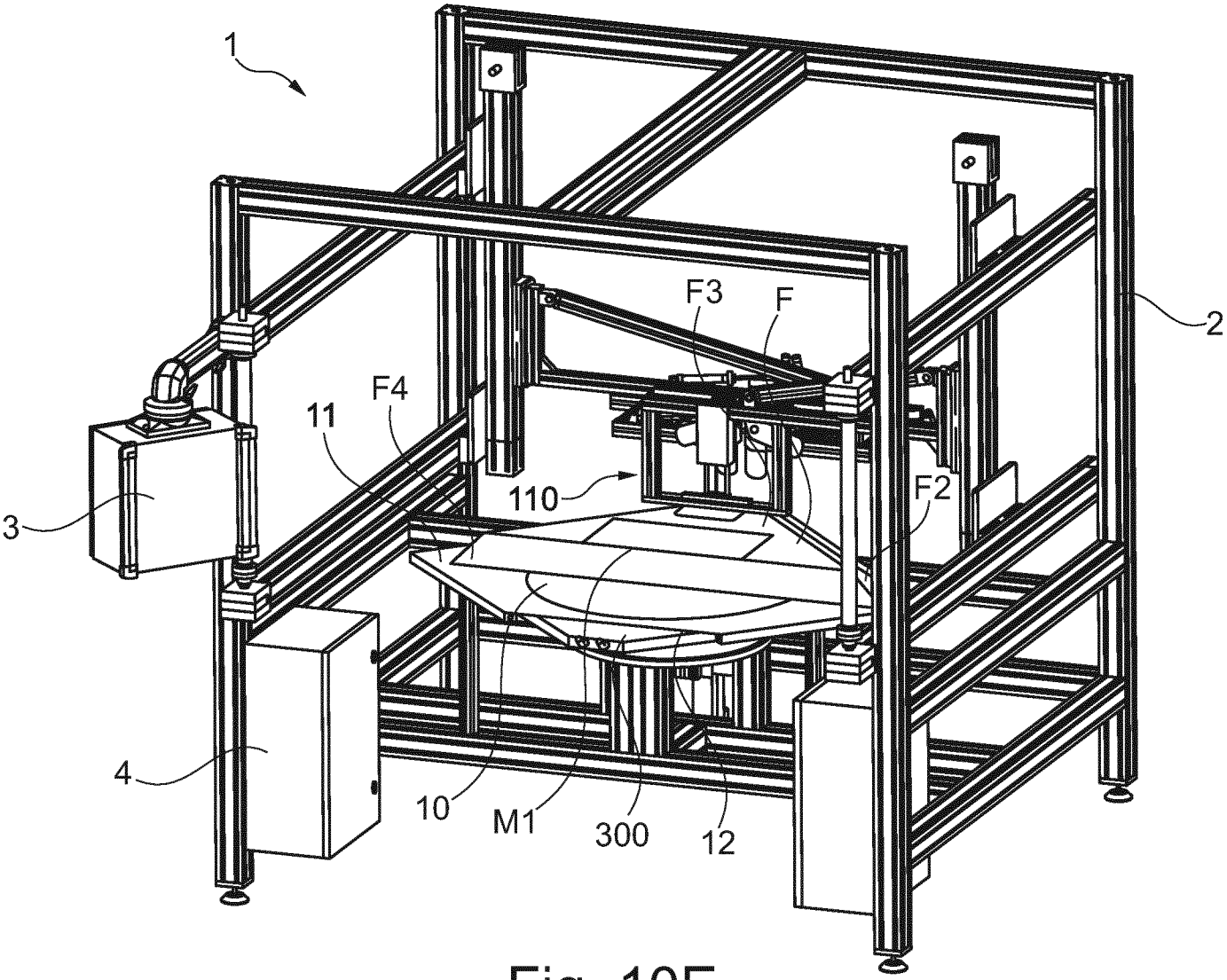
Figure 10F:
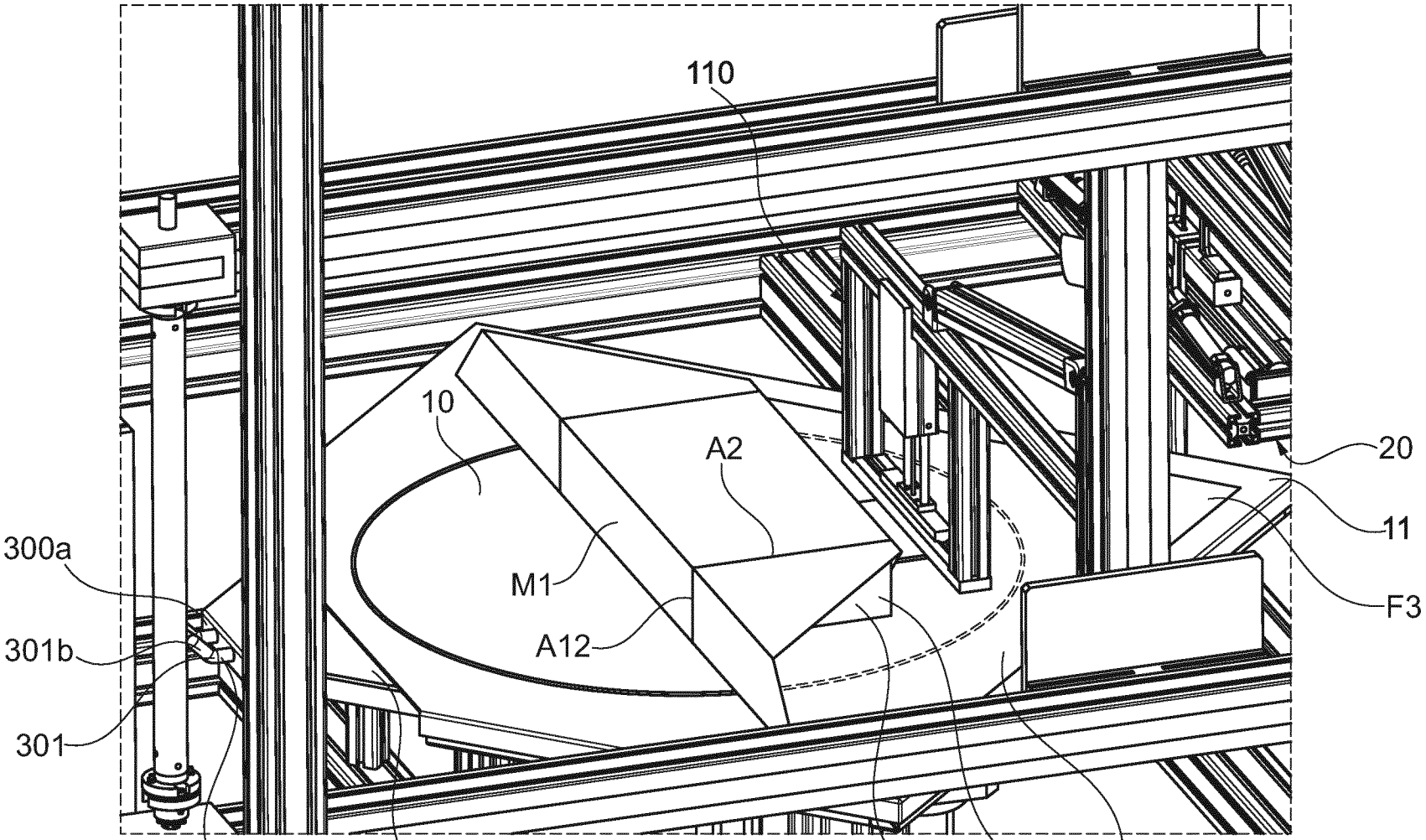
Figure 10G:
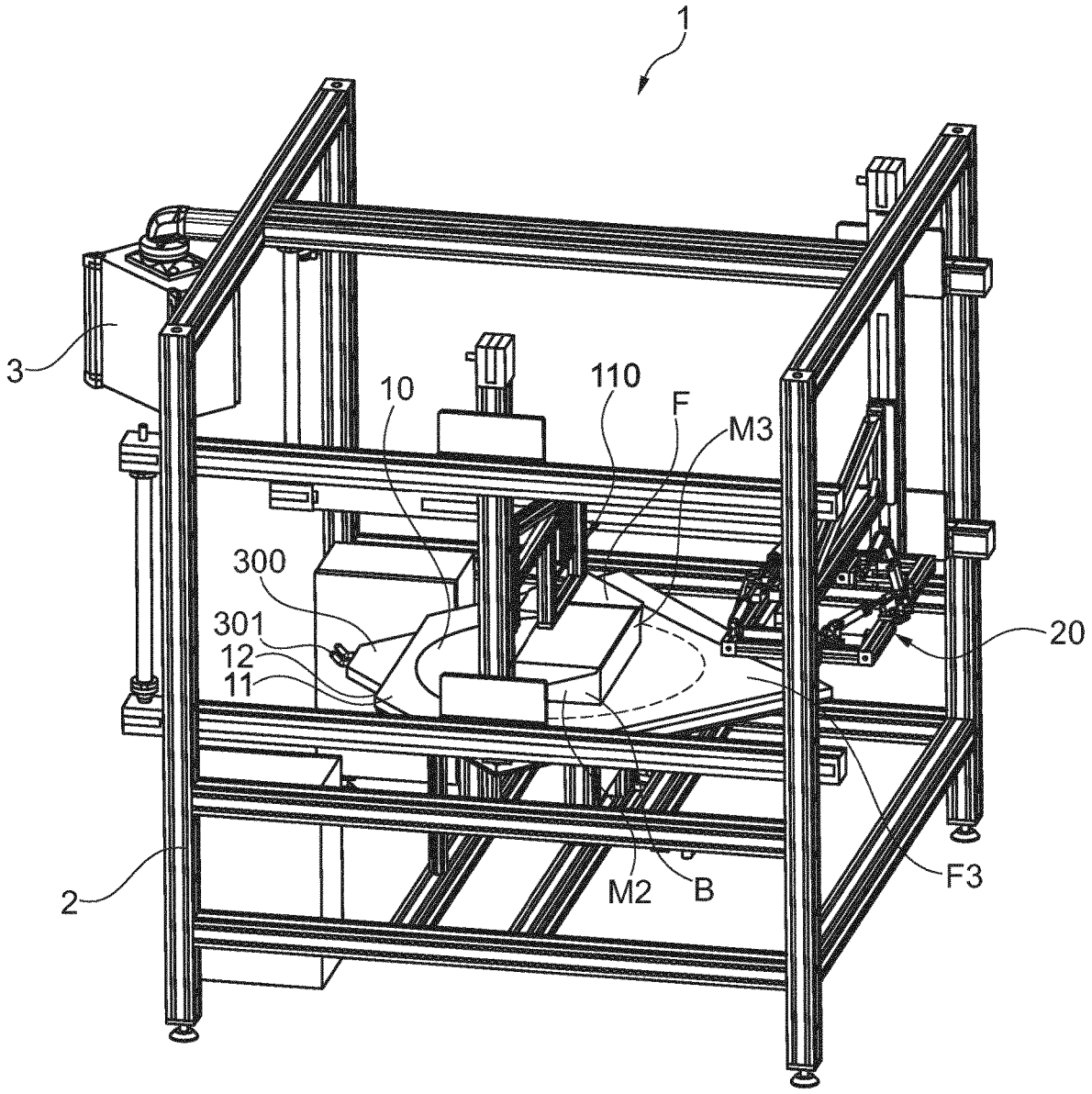
Figure 10H:
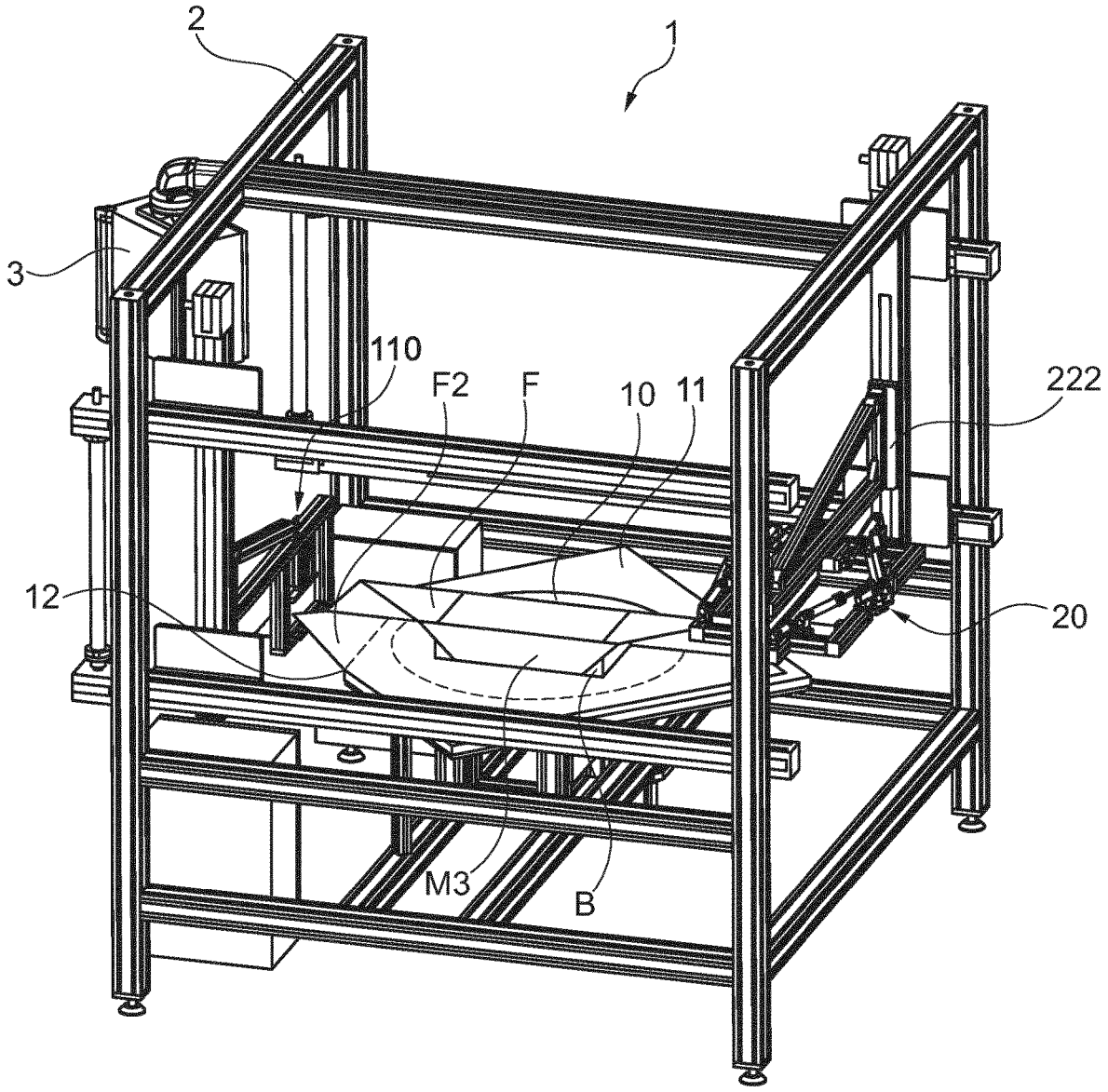
Figure 10I:
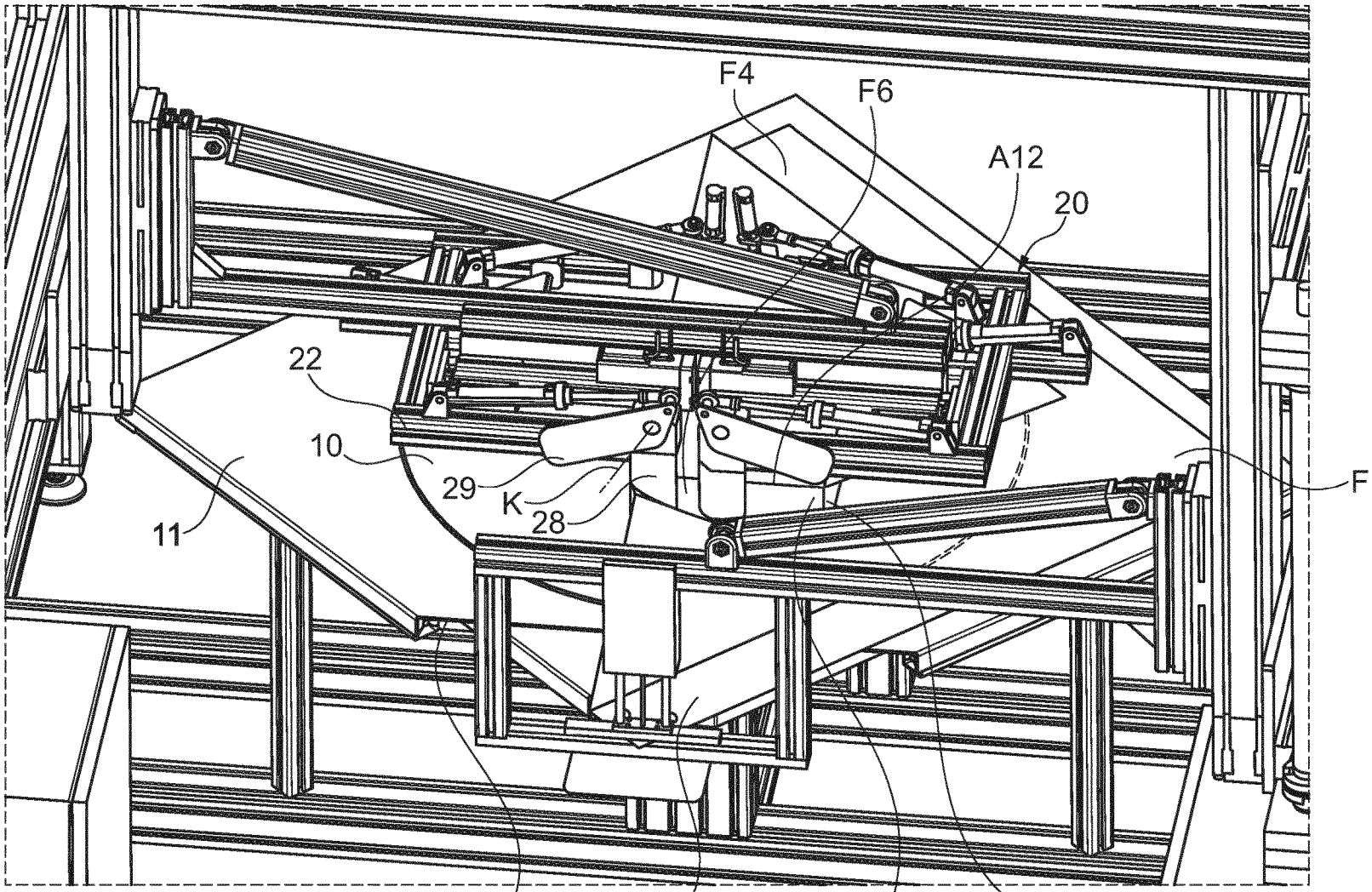
Figure 10J:
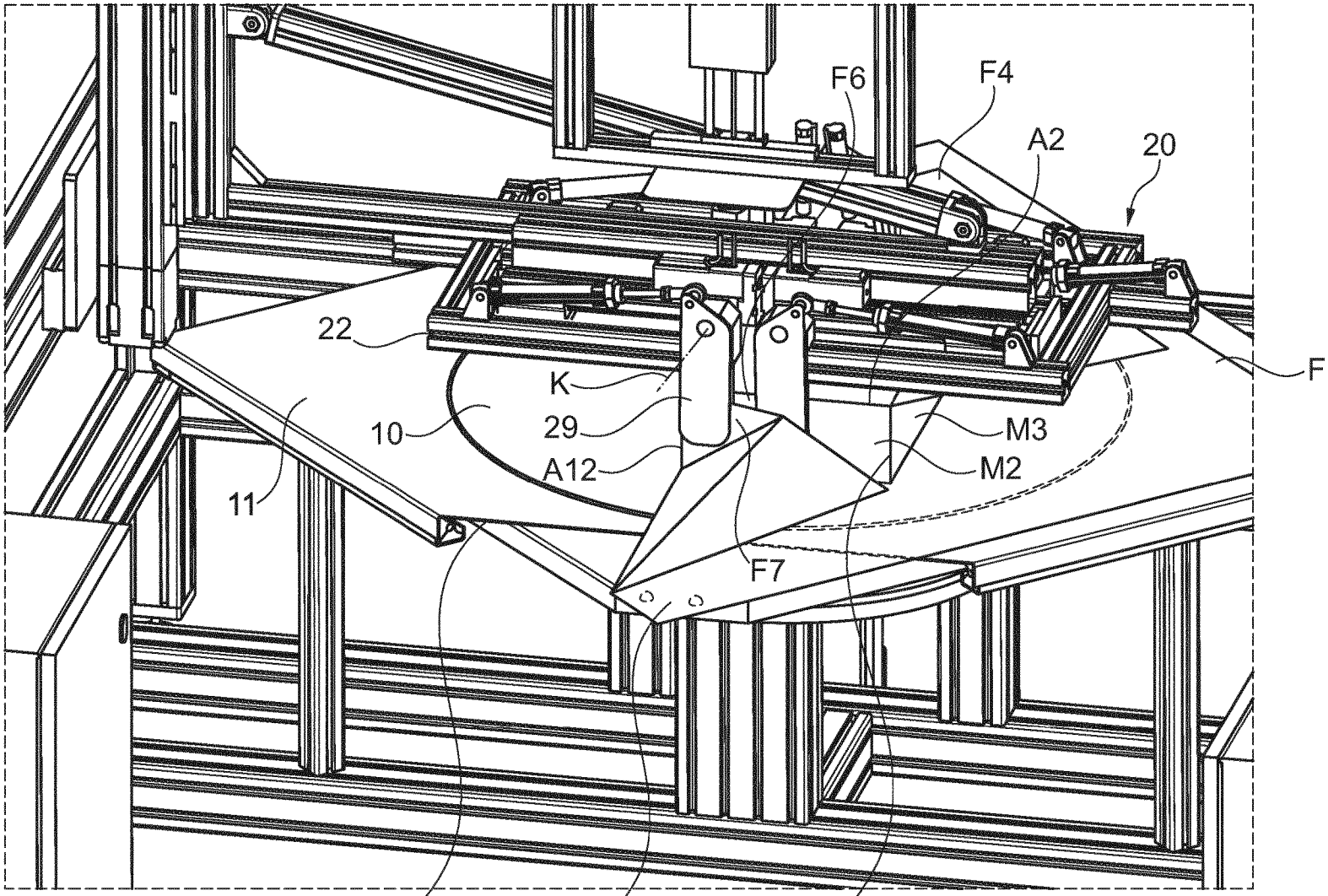
Figure 10K:
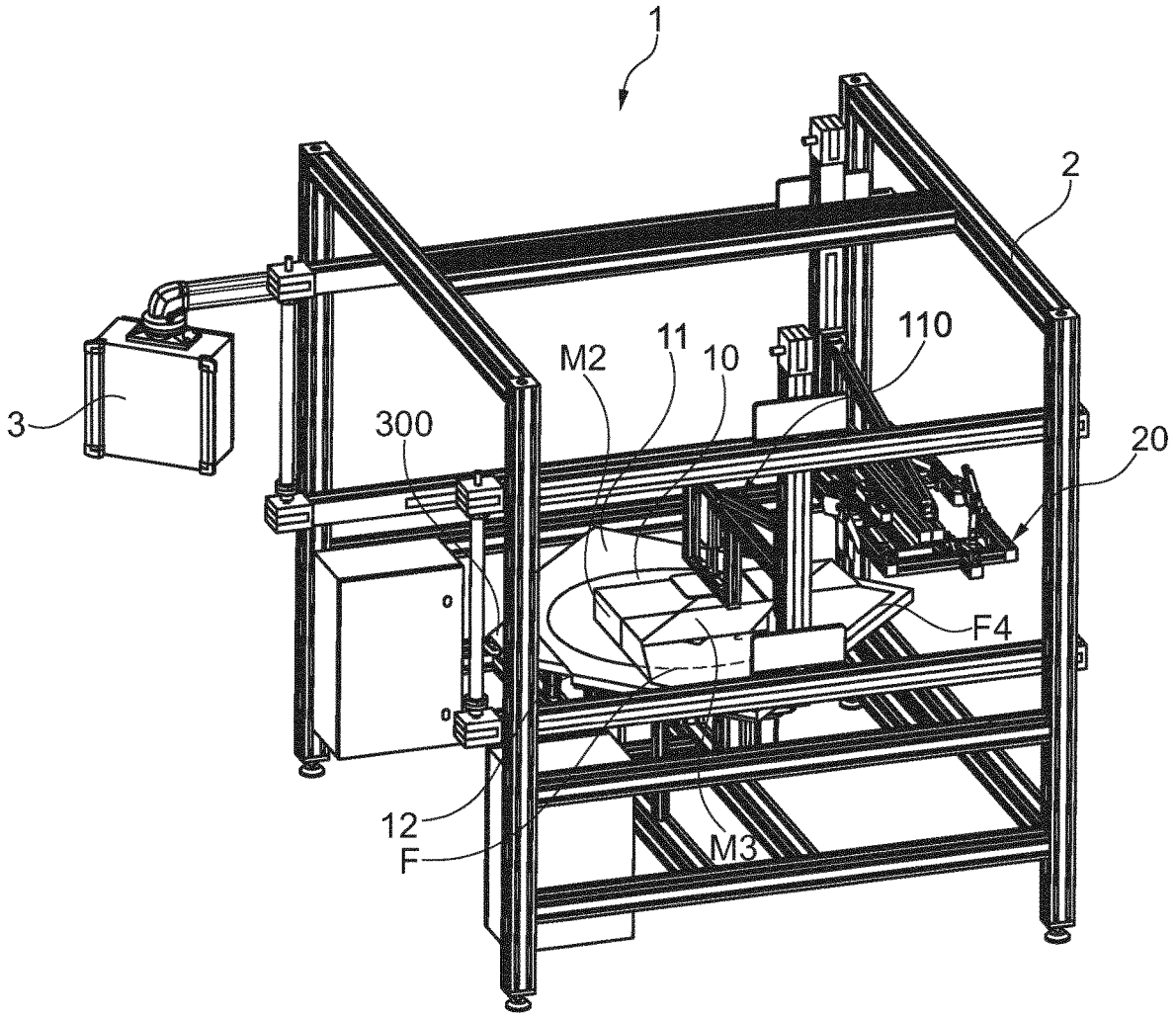
Figure 10L:
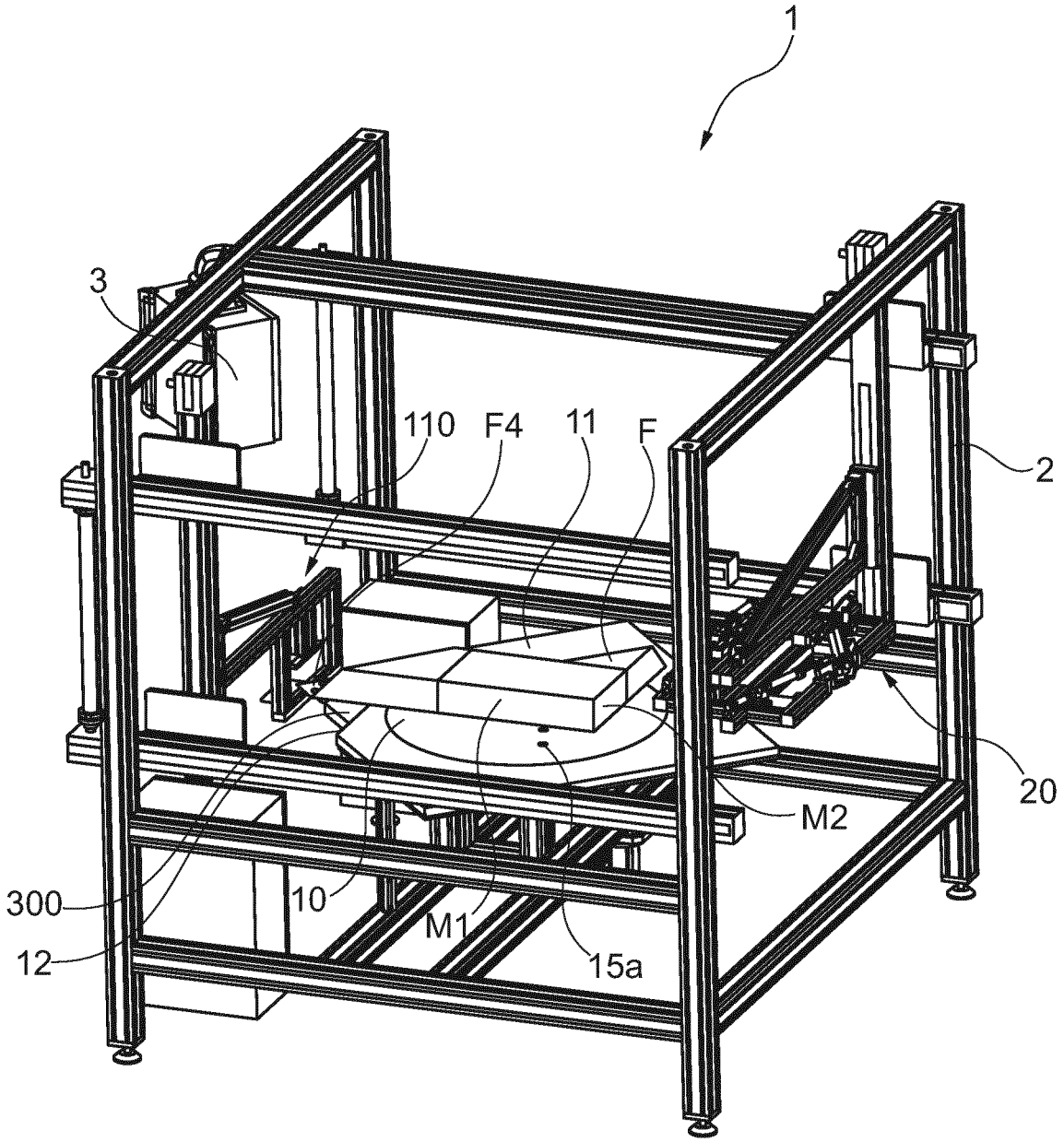
Figure 10M:
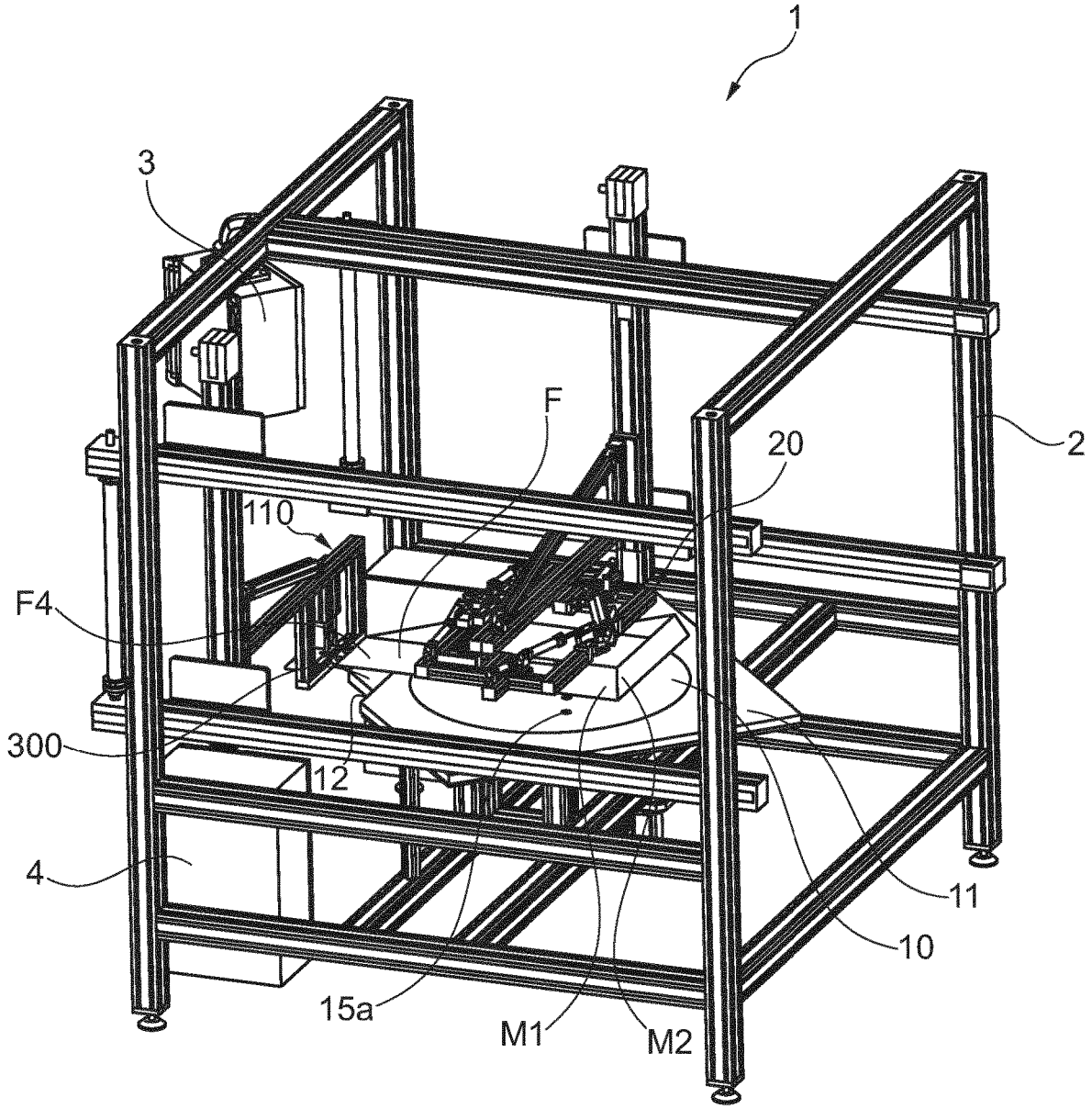
Figure 10N:
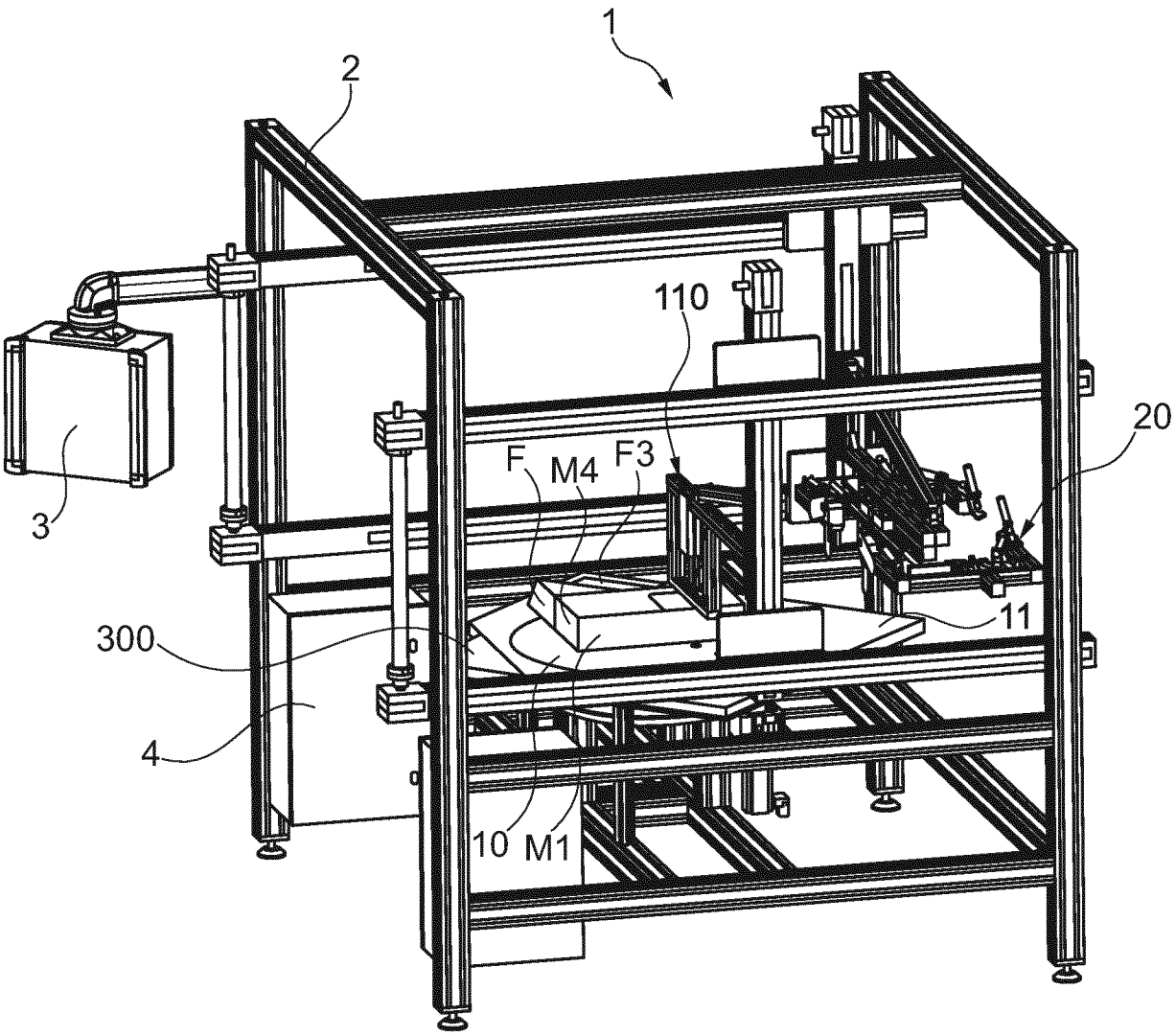
Figure 10O:
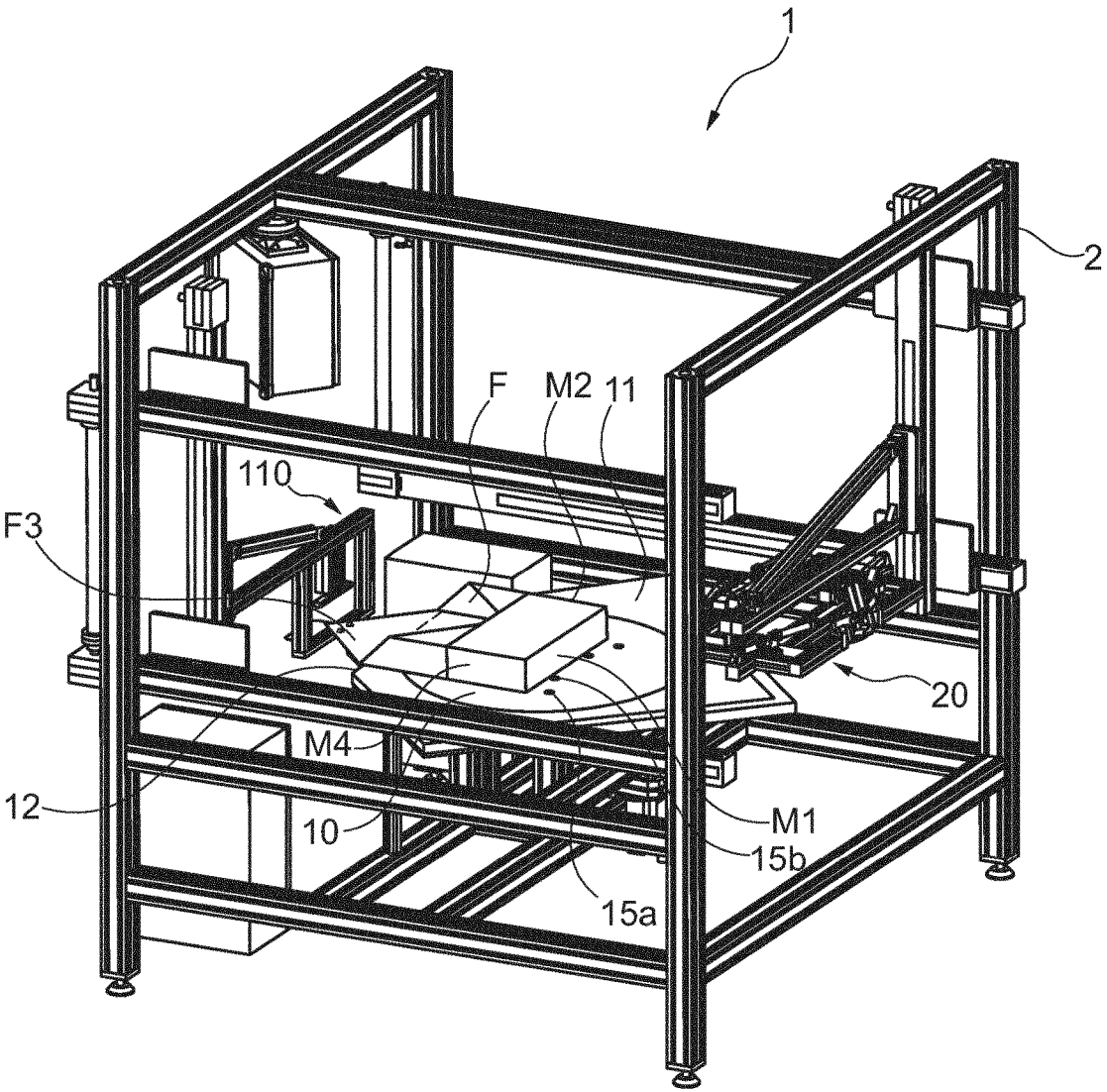
Figure 10P:
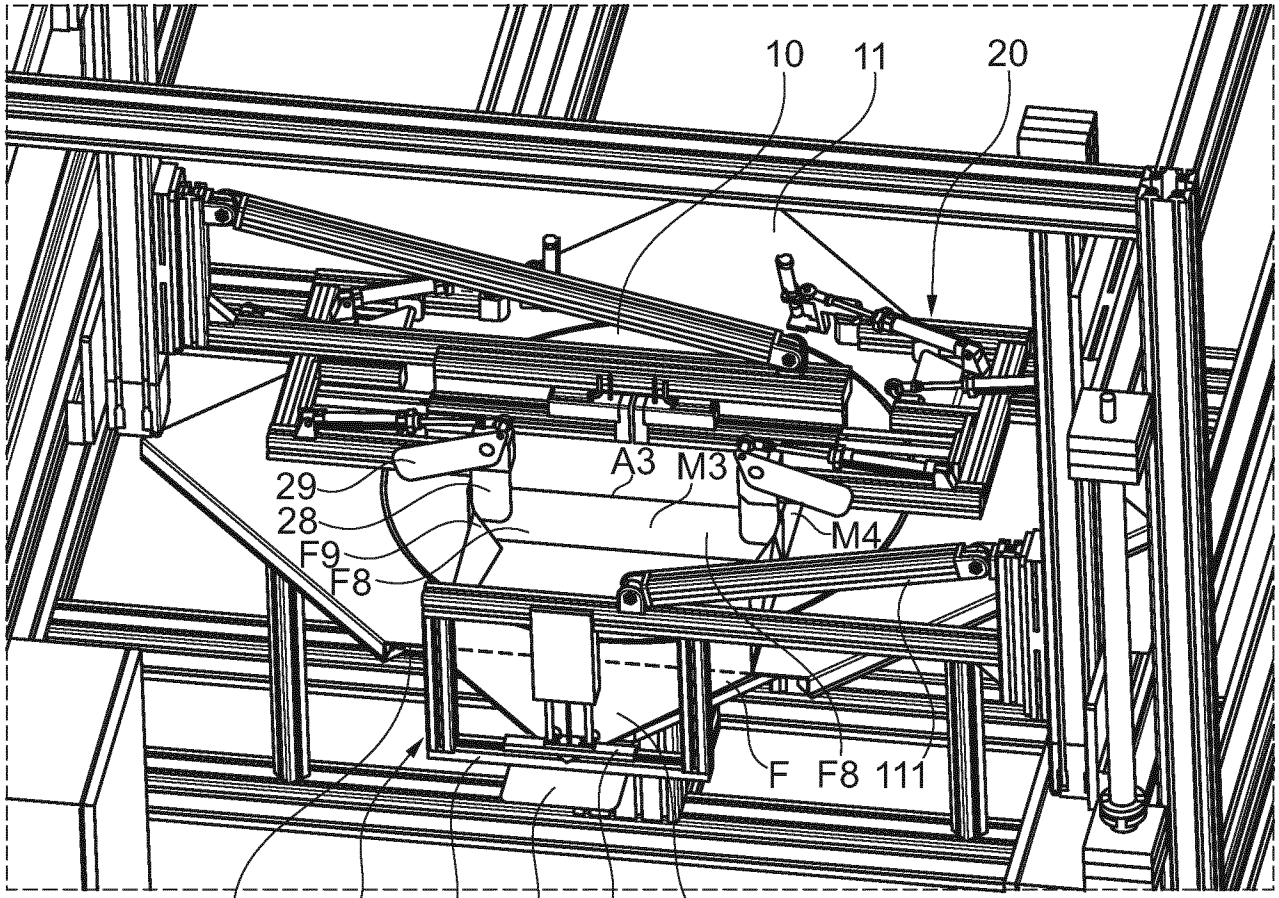
Figure 10Q:
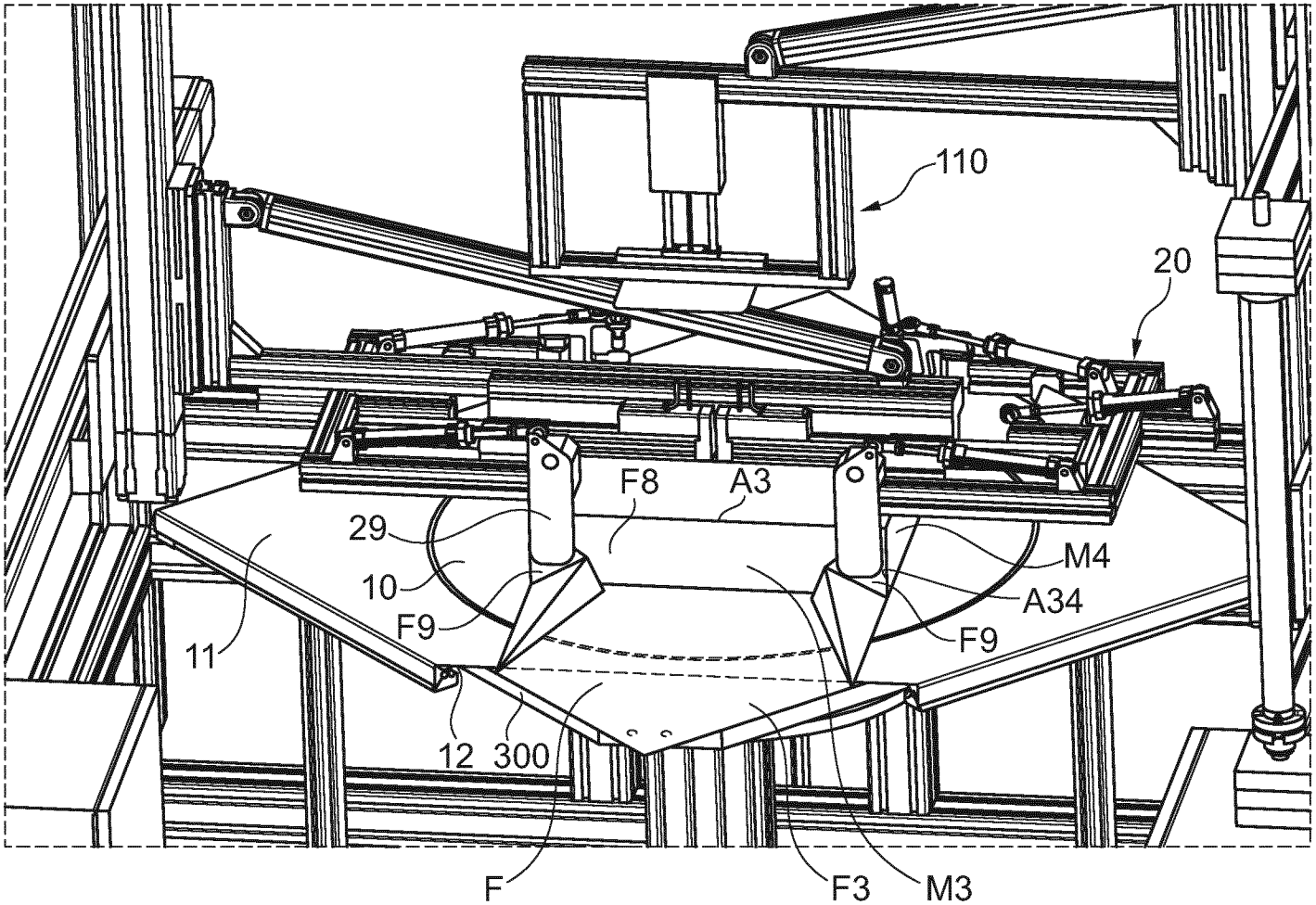
Figure 10R:
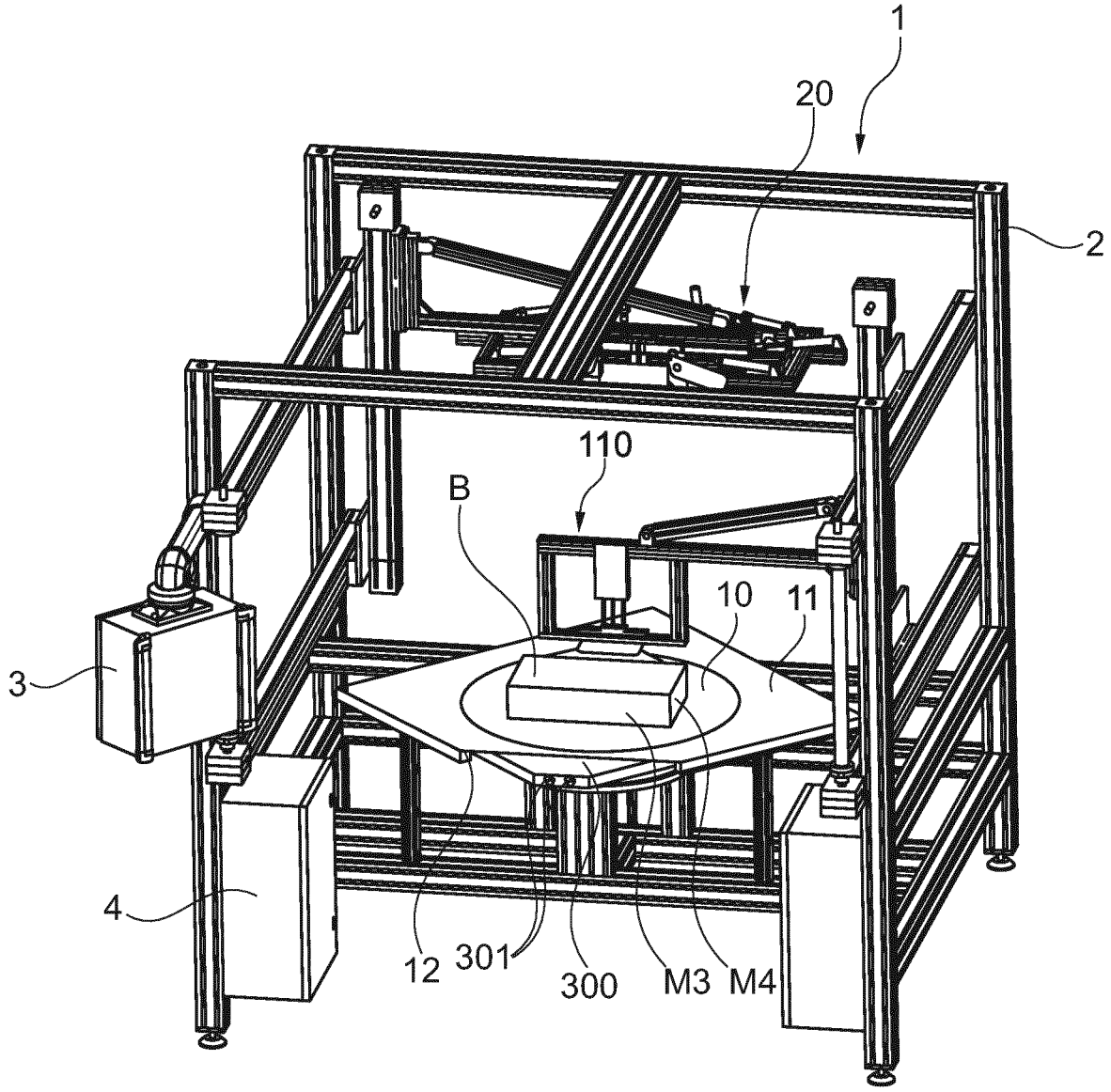
Figure 10S:
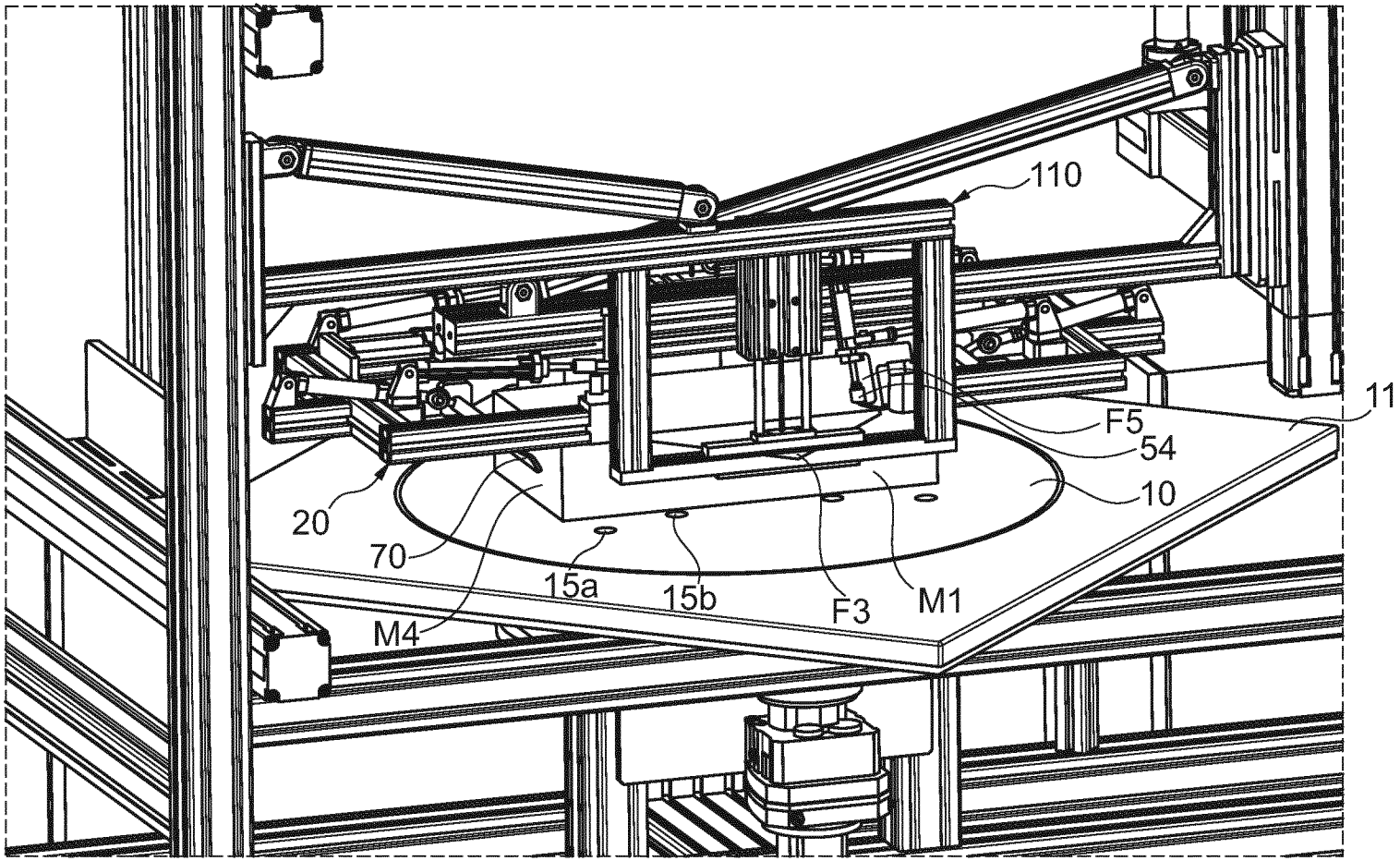
Figure 10T:
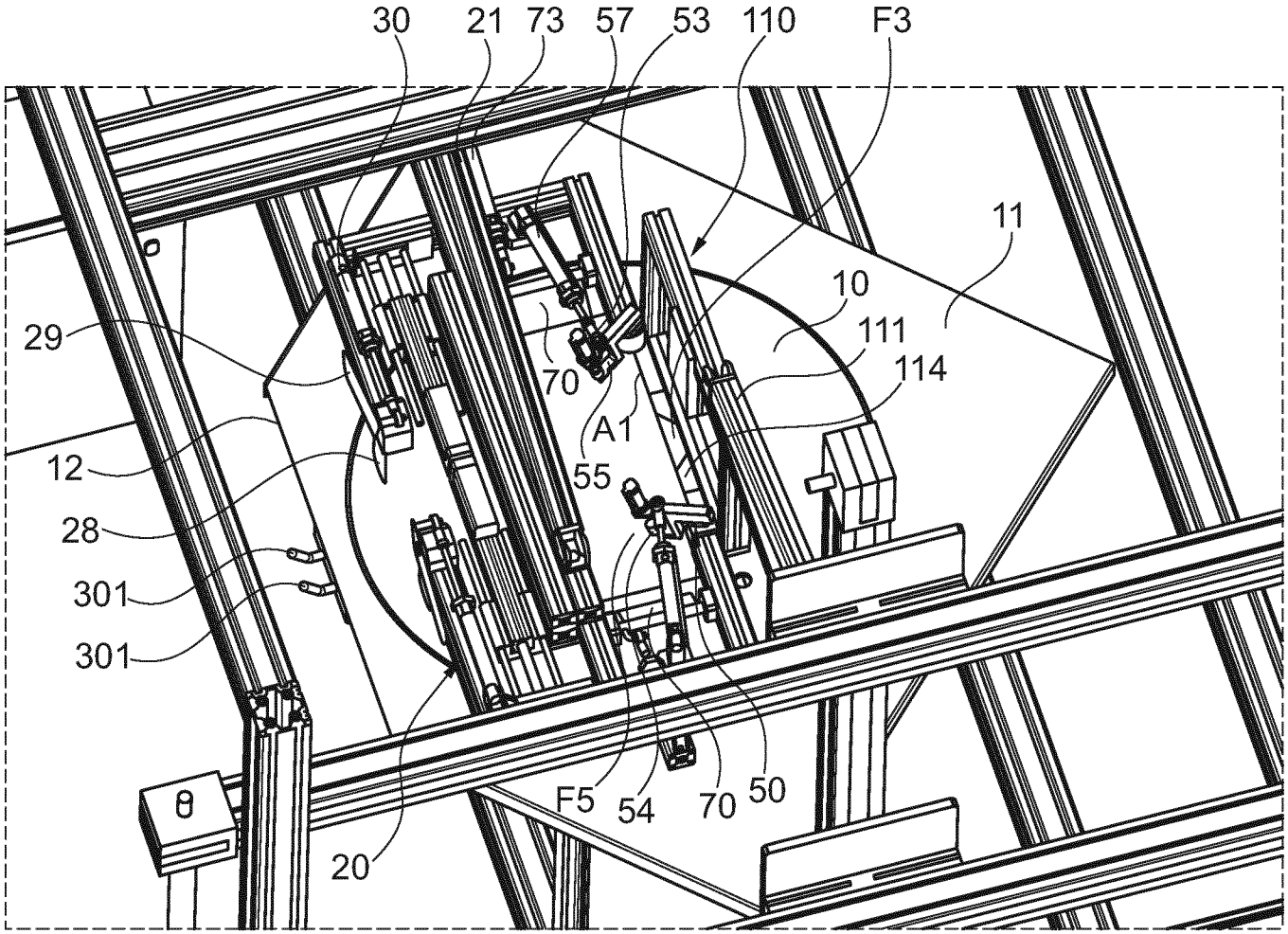
Figure 10U:
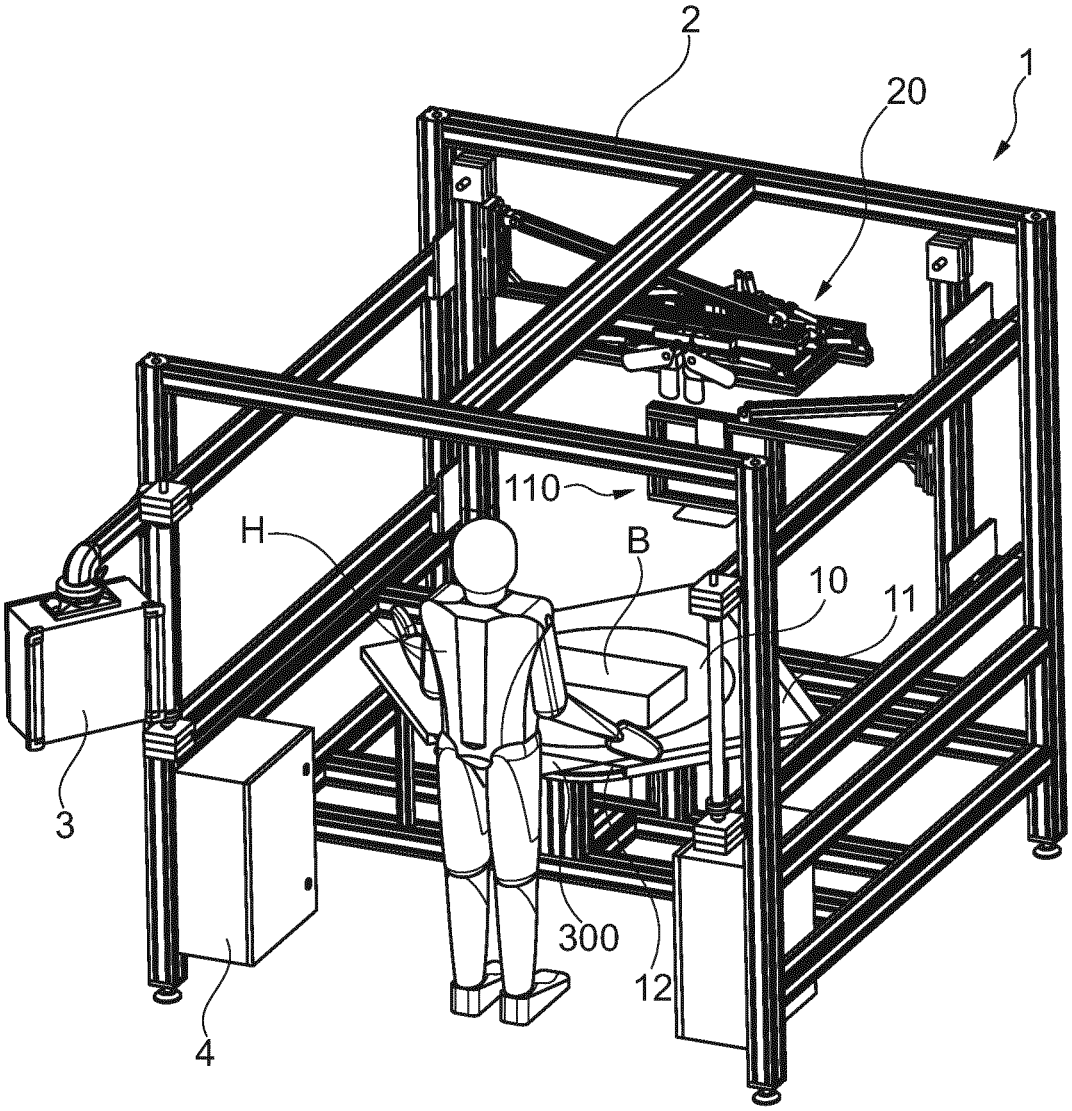
Figure 11:
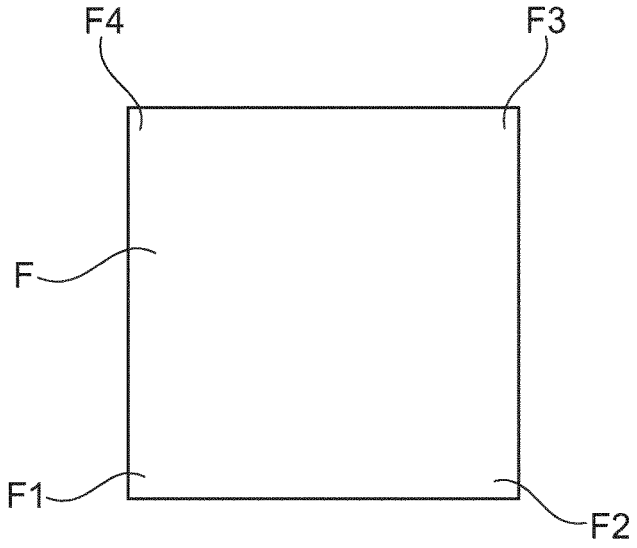
Figure 12:
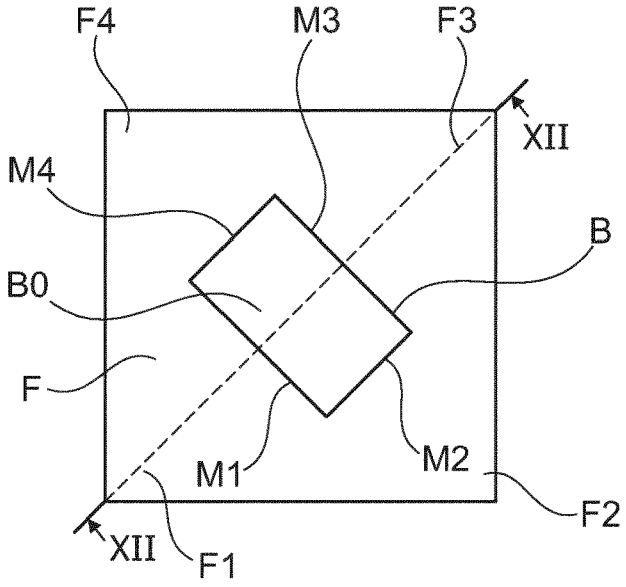
Figure 13:
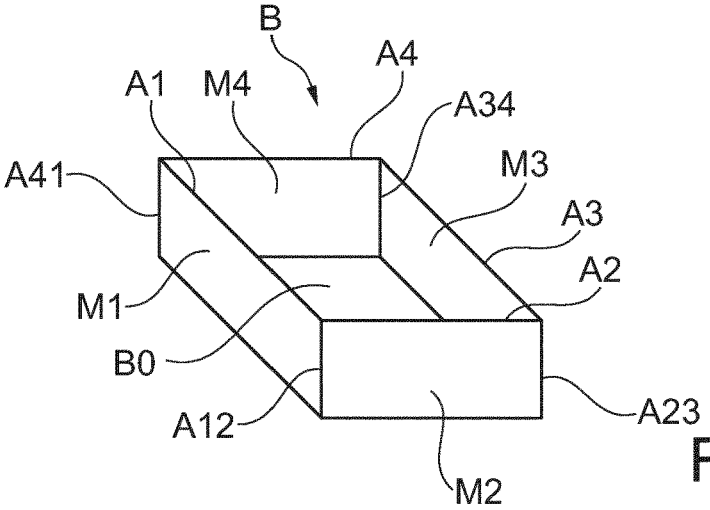
Figure 14:
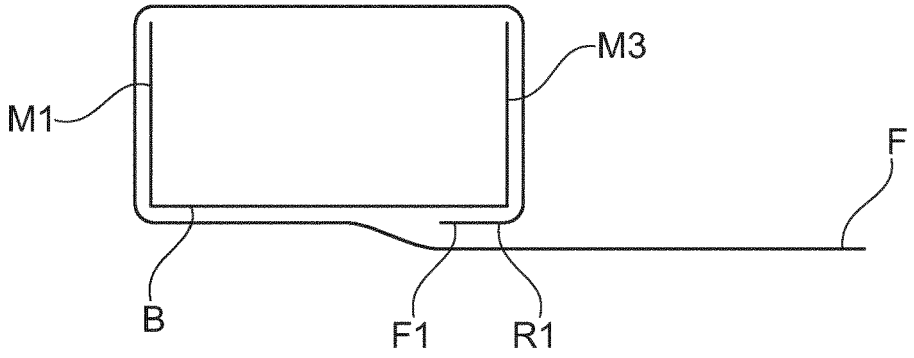
Figure 15:
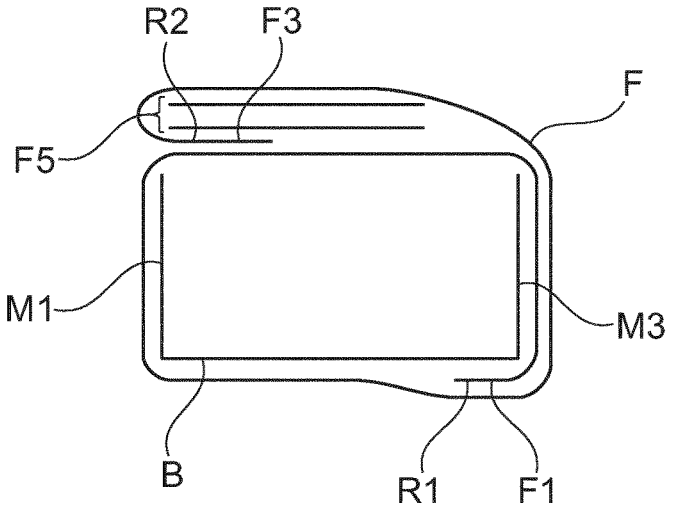
Figure 16:
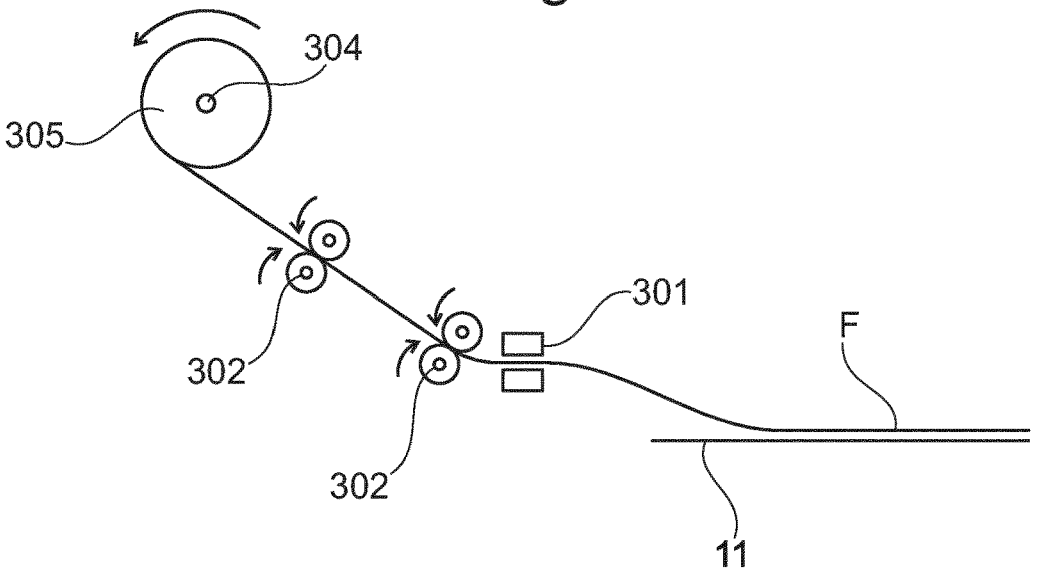
Figure 17:
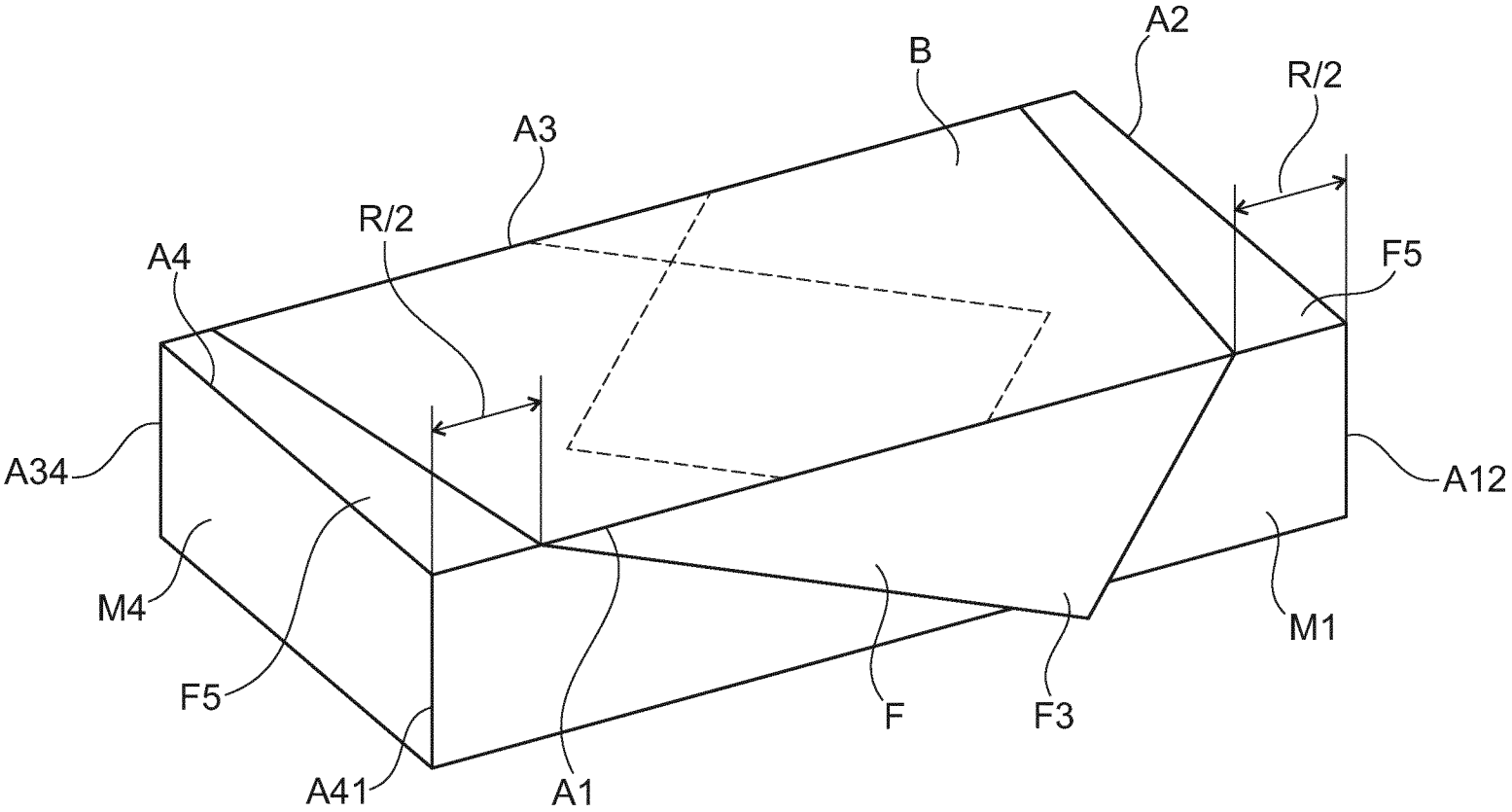

The invention may be better understood from reading the following detailed description of one exemplary nonlimiting embodiment thereof, and from studying the attached drawing in which:

FIGS. 1A to 1D schematically and in perspective depict one example of a machine according to the invention, FIGS. 2 and 3 depict in isolation the gripping tool of the machine of FIG. 1, FIG. 4 depicts a detail of the gripping tool, FIG. 4A is a cross section on plane A of FIG. 4, FIGS. 5 to 9 depict in isolation the holding and/or folding tool, in various configurations, FIGS. 10A to 10U illustrate various stages of the operation of the machine for packaging a sterilization basket, FIG. 11 depicts in isolation the sterilization sheet F viewed from above, FIG. 12 is a view analogous to FIG. 11, with the sterilization basket B placed on the sheet, FIG. 13 depicts in isolation the sterilization basket B in perspective, FIGS. 14 and 15 are schematic and partial cross sections, on XII-XII of FIG. 12, after the first and second tucked flaps have been formed respectively, FIG. 16 illustrates a system for supplying the machine with sterilization sheets, and FIG. 17 illustrates in isolation the sterilization basket B after the formation of the fourth fold and before the formation of the second tucked flap.

The machine 1 according to the invention, depicted notably in FIG. 1, comprises a chassis 2 and a control panel 3 and one or more electrical and/or pneumatic and/or hydraulic cabinets 4.

The machine 1 may be incorporated into a production line and connected to conveyors and/or automatons that are able to bring in the sterilization sheets and the baskets that are to be packaged and, where appropriate, recover the packaged baskets. These ancillary elements are not depicted in the drawing, for the sake of clarity.

The term "basket" refers here to any receptacle capable of accommodating objects that are to be sterilized.

The machine 1 comprises a rotating plate 10, i.e. a turntable 10, arranged at the center of a horizontal table 11, for example of square or rectangular shape with one front corner 12 truncated.

The table 11 on its underside face comprises an element 300, for example of triangular shape, with a truncated corner 300*a* comprising fingers 301. In the example considered, there are two of these fingers 301. The fingers 301 may be circular in cross section and may have a horizontal first part 301*a*, connected to the truncated corner 300*a*, continued by a second part 301*b* that is angled upward and forward, as illustrated in FIG. 10F. In the example considered, the fingers 301 are fixed. The fingers 301 may make it possible to hold a corner of a sterilization sheet F in the horizontal position. The element 300 is able to move horizontally (along the axis Y) between a retracted position in which the truncated corner 300*a* of the element 300 is flush under the truncated corner 12 of the table 11, as illustrated in FIG. 1A, and a deployed position in which the element 300 is situated forward of the truncated corner 12 of the table, as illustrated in FIG. 1B. The element 300 may make it possible, in its retracted position, to make it easier for a human operator H or any suitable conveying system and/or automaton to move closer to the turntable 10, notably to set down the basket and/or to remove it from the table 11. In its deployed position, the element 300 may be able to receive a corner of a sterilization sheet F. The element 300 is moved in a controlled fashion, according to the progress being made with the packaging process, for example using stepping motors or using any other suitable drive mechanism.

The table 11 may be supported by the chassis 2 as illustrated. The presence of the truncated front corner 12 may allow a user to move closer to the turntable 10.

The turntable 10 is moved by a drive system, not depicted, that allows it to be driven in rotation about a vertical axis through a desired angle, preferably in one direction or the other, according to the progress through the stages of the packaging process, as will be detailed later on.

The turntable 10 is equipped with fingers 15*a* and 15*b* able to move vertically between a retracted position in which the upper end of the fingers 15*a* and 15*b* lies flush with the surface of the turntable 10 or is set back therefrom, and a deployed position in which the fingers 15*a* and 15*b* project above the surface of the turntable 10. In the example considered, there are four of these fingers 15*a* and 15*b* and their function will be detailed later on. In FIG. 1C, the turntable 10 is illustrated with the fingers 15*a* in the deployed position and the fingers 15*b* in the retracted position, and FIG. 1D illustrates the turntable 10 with the fingers 15*a* in the retracted position and the fingers 15*b* in the deployed position.

The fingers 15*a* and 15*b* may be circular in cross section for example, and driven by any suitable mechanism, moved by an electric, pneumatic or hydraulic motor.

The machine 1 moreover comprises a gripping tool 110 and a folding tool 20, both of which can be moved relative to the framework of the chassis 2 when the machine is in operation in order to perform various operations of the packaging process.

In the description which follows, reference is made to an orthonormal frame of reference XYZ associated with the machine. The axis Z is vertical, the axis Y corresponds to a depthwise movement, forward and backward, and the axis X to a lateral movement.

The gripping tool 110 is able to move along the axis Y and the axis Z, in a controlled fashion. For that purpose, the chassis 2 comprises two parallel horizontal rails 6 positioned at different heights, oriented along the axis Y, along which two respective carriages 7 run. A vertical post 8 is fixed to the carriages 7 and moves with them. A carriage 119 may move vertically along this post 8.

The movement of the carriages 7 and 119 is performed in a controlled fashion, according to the progress made through the packaging process, for example using stepping motors or any other suitable drive mechanism.

If reference is made to FIGS. 2 to 4, it may be seen that the gripping tool 110 comprises a bracket 111 fixed at its base to the carriage 119. This bracket 111 bears a pressing system 113 and a frame 112 bearing a plate 114.

The pressing system 113 at its lower end comprises a horizontal shoe 115, the longitudinal axis of which is parallel to the axis X, borne by two vertical posts 117 which are guided in their movement by a guide device 116 provided internally with a drive mechanism that makes it possible to control the vertical movement of the shoe 115. In the example considered, the tool 110 also comprises a hose 118 selectively connected to a source of vacuum. This hose 118 opens via at least one internal duct 118*a* onto the underside face of the shoe 115 via at least one orifice 118*b* and, when connected to the source of vacuum, allows the sheet to be held through a suction effect, thanks to the depression created, notably so as to lift the sheet.

The plate 114 is borne by a profile section 112*a* which defines the lower side of the frame 112. This profile section 1/2*a* has, on its top face 112*c* which acts as a bearing surface for the shoe 115, a groove 112*b*. The shoe 115 on its underside face has a boss 115*a*, the profile of which has a cross section that complements that of the groove 112*b*, as can be seen in FIG. 4A.

As can be seen in FIGS. 2 to 4, the plate 114 is fixed under the profile section 112*a* and preferably has a thickness that decreases with increasing distance away from the profile section 112*a*. In the example considered, the plate 114 is rectangular in shape, with a long side parallel to the longitudinal axis of the profile section 112*a*, and which may or may not be centered relative to the latter.

The depth $p_1$ of the plate 114, measured in a direction perpendicular to the longitudinal axis of the profile section 112*a*, is for example comprised between 100 and 200 mm.

The width $l_1$ of the plate 114 is for example comprised between 150 and 250 mm.

The length of the shoe 115 may be slightly greater than that of the plate 114, being for example comprised between 150 and 300 mm.

The shoe 115 is preferably centered within the frame 112, as illustrated.

The plate 114 may project toward the rear of the profile section 112*a* by a distance comprised between 100 and 200 mm.

The top 115*c* of the boss 115*a* may be flattened, the boss 115*a* projecting for example by a distance $e_2$ from the rest of the underside face 115*b* of the shoe 115, this distance $e_2$ being for example comprised between 0 and 30 mm.

The width $l_2$ of the boss 115*a* may be comprised between 0 and 30 mm.

The invention is not restricted to a particular profile for the boss 115*a* and the latter has, for example, a semicircular cross section in a variant which has not been illustrated.

The folding tool 20 will now be described with reference to FIGS. 5 to 9. This tool is borne by a bracket 21 which is connected to a carriage 222 which is able to move vertically on a vertical post 40 of the chassis 2, this post 40 being borne by the carriages 41 which are themselves able to move horizontally along the axis Y on respective parallel horizontal rails 42. In this way, the folding tool 20 may be controlled in terms of its position along the axes Y and Z.

The bracket 21 has a lower beam 21*a*, the longitudinal axis of which is oriented parallel to the axis X.

The folding tool 20 comprises two lateral parts 22. Each lateral part 22 comprises a set of guide rods 23 which slide in guides 24 and the movement of which is controlled by motors 25, for example stepping motors or brushless motors.

As a preference, the horizontal movement along the axis X of the lateral parts 22 takes place symmetrically toward or away from one another, about a median plane of symmetry of the folding tool 20.

The travel along the axis X of each lateral part 22 is, for example, comprised between 0 and 250 mm. Each lateral part 22 may be identical in construction to the other lateral part 22.

In the example illustrated in FIGS. 5 to 9, each lateral part 22 comprises a U-shaped frame 26 facing toward the inside, the guide rods 23 being connected to a profile section 26*a*, the longitudinal axis of which is parallel to the axis Y, constituting the base of the U.

The front branch 26*b* of the frame 26 at its free end bears a vertical plate 28 which is directed downward. This plate 28 is preferably fixed to the front exterior face of the profile section 26*b*.

Figure 6:
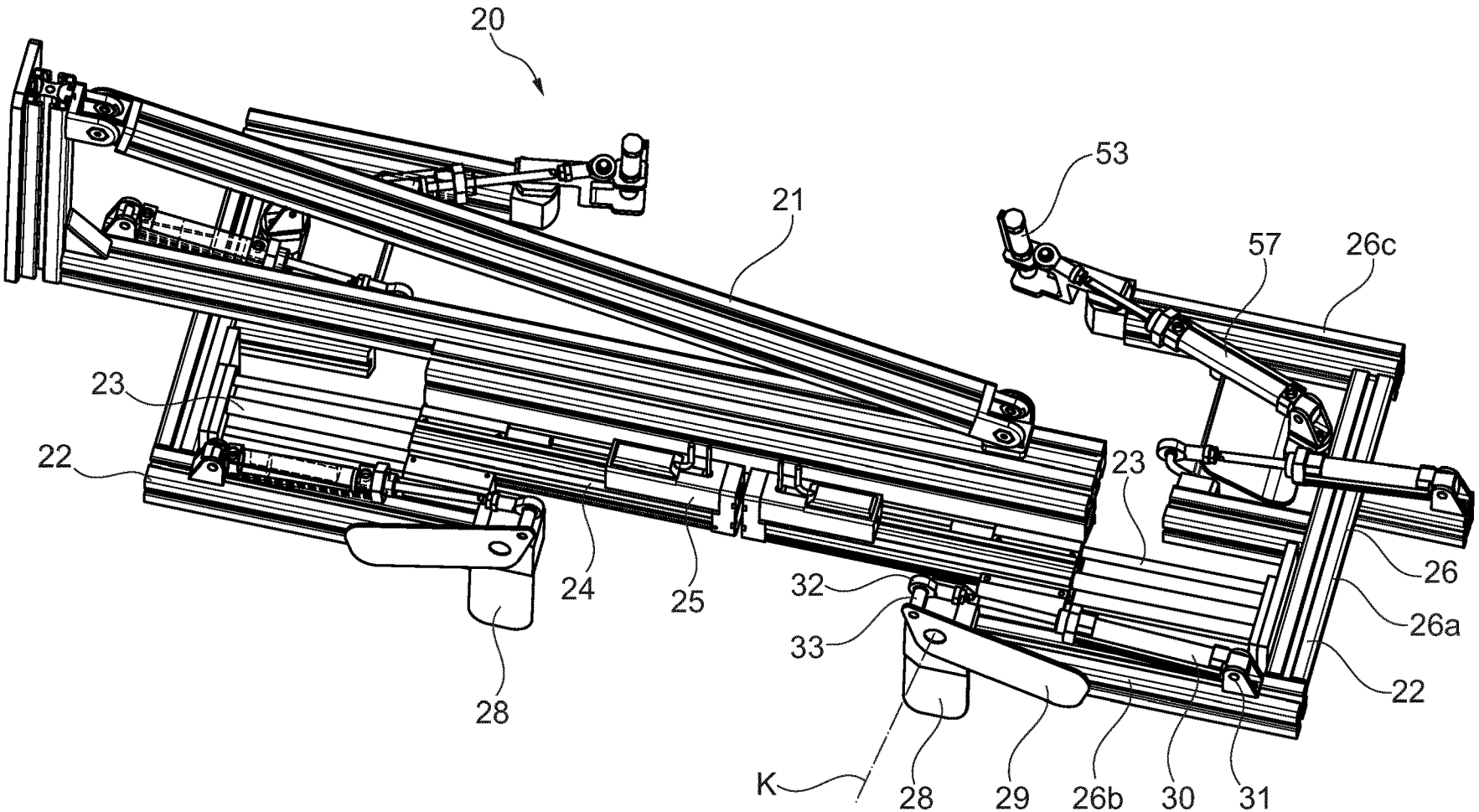

Each lateral part 22 also comprises, as can be seen notably in FIG. 6, a mobile element 29, in the form of a plate in the example considered, which is articulated about an axis of rotation K parallel to the axis Y, the rotational movement of this plate 29 being effected under the action of an actuator 30, of which one end 31 is articulated to the profile section 26*b*, and the other end 32 is articulated to a pin 33 attached to the plate 29, in the vicinity of the axis of rotation K.

Figure 7:
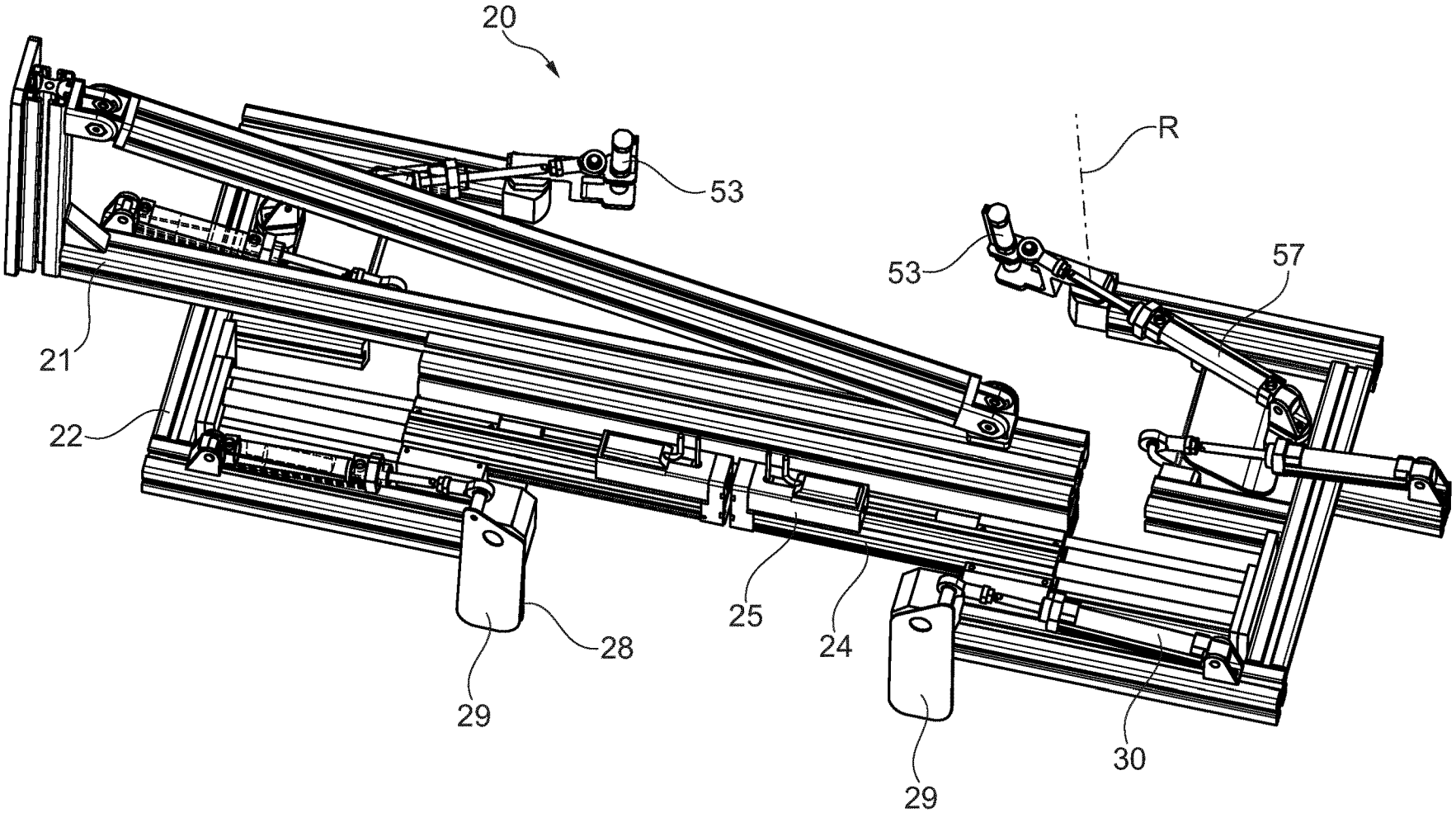

The plate 29 is of a length greater than that of the plate 28, so that when it is folded down vertically along the plate 28, as illustrated in FIG. 7, it extends below the latter.

In the example illustrated, the plates 29 are situated forward of the plates 28.

As can be seen more particularly in FIG. 8, the rear profile section 26*c* of the frame 26 comprises a gripper 50, articulated about a vertical axis of rotation R at the free end of the profile section 26*c*. The gripper 50 comprises a U-shaped support 51, an actuator 53 being mounted on the upper branch of the support 51. The actuator 53 at its lower end bears a press roller 54, which can be lowered toward the foot 55 of the support 51.

The support 51 is made to rotate by an actuator 57, articulated at one end to a clevis 58, itself connected with the ability to pivot, about a vertical axis of rotation, to a mount 26*e*. The latter is fixed to the base profile section 26*a*, on the interior side thereof.

The opposite end of the actuator 57 is articulated at 59 to the upper branch 52 of the support 51.

Each lateral part 22 of the folding tool 20 also comprises a holding panel 70, which is articulated about a horizontal axis of rotation S, by pivot pins mounted respectively on the rear profile section 26*c* and on an intermediate profile section 26*f* which is perpendicular to the base profile section 26*a*, situated substantially mid-way along the length of the latter and shorter in length than the front 26*b* and rear 26*c* profile sections.

The holding panel 70 is made to rotate about the axis S by an actuator 73, one end of which is articulated to a clevis 74 fixed to a profile section 26*g* connected at right angles to the base profile section 26*a* on the exterior side thereof. The actuator is connected at 75, at its other end, to a link 76 which rotates with the holding panel 70. Thus, when the actuator 73 is actuated, the lengthening or shortening of same is converted into a rotation of the holding panel 70.

Various stages in the operation of the machine 1 for packaging a sterilization basket using one or more sterilization sheets will now be described with reference to FIGS. 10A to 10U.

The sterilization basket B in the example considered has a horizontal bottom BO and four vertical upright sides M1, M2, M3 and M4.

First of all, as illustrated in FIG. 10A, a first sterilization sheet F is brought by any suitable means, for example by being placed there manually, as illustrated, by an operator H, onto the table 11.

The sterilization sheet F may be picked up from a stack of sheets, or cut to the desired format from a roll of a sterilization packaging material, which is unrolled manually or automatically.

Where the sterilization sheets are obtained by cutting from a roll of a sterilization packaging material, the cutting of the sterilization sheets may be performed by a blade which is moved by hand or which is motorized. In an alternative, the sterilization sheets are precut.

As illustrated in FIG. 16, the sterilization sheet F may be brought onto the table 11 from a roll 305 of a sterilization packaging material which is unrolled by a reel 304. Guide rollers 302 are able to guide the sterilization sheet F as far as a cutting device 301 allowing the sheet F to be cut to the desired size.

The dimensions of the sheet F are less than those of the table 11. The sheet F is, for example, square or rectangular in shape, the length of the sides being comprised between 750 and 1000 mm.

The dimensions of the sterilization sheets F used are determined by the dimensions of the baskets B that are to be packaged.

The machine 1 may comprise a system for automatically measuring the dimension of the sterilization basket B that is to be packaged and for adapting the dimensions of the sterilization sheet accordingly. In order to be able to adapt the dimension of the sterilization sheets to suit the dimensions of the baskets, this system may, in the event that the sterilization sheet F is square in shape, be based on the formula $$L_{side} = \frac{3(l+h)+L-R}{\sqrt{2}}$$

where $L_{side}$=the length of the side of the sterilization sheet F, l=the width of the sterilization basket, L=the length of the sterilization basket, h=the height of the sterilization basket and R=the value of non-overlap (in mm).

The sterilization sheet F is known per se, having the property of being permeable to a sterilization gas such as ethylene oxide, while at the same time constituting a sterile barrier against microorganisms.

Depending on the strength and elasticity desired for the packaging of the sterilization basket B, the sterilization sheet F may notably be selected from a crepe paper, a reinforced paper, a cellulose-based nonwoven or a sheet of the SMS type. The grammage of the sterilization sheet F may be comprised between 30 and 90 g/m$^2$, or better, between 40 and 80 g/m$^2$. The choice of grammage of the sterilization sheet may notably be based on the size of the basket that is to be packaged.

As illustrated in FIGS. 11 and 12, the sterilization sheet F has opposite corners F1 and F3 on the one hand, and F2 and F4 on the other.

The sterilization sheet F is, for example, the one marketed by the STERIMED company in the STERISHEET range.

Once the sheet F has been set down on the table 11, the gripping tool 110 can be activated as illustrated in FIG. 10B, by being moved along the axes Y and Z so as to approach the turntable 10, which can be seen in hidden detail in the drawing underneath the sheet F.

Next, as illustrated in FIG. 10C, the sterilization basket B is placed on the sterilization sheet F, this basket B being brought by any suitable means, for example manually by an operator H as illustrated or, as an alternative, by any suitable conveying system and/or automaton. As illustrated in FIG. 12, the sterilization basket B may be placed at the center of the sterilization sheet F, the upright sides M1 and M3 being oriented perpendicular to the diagonal connecting the corners F1 and F3 of the sterilization sheet F.

The sterilization basket B contains instruments intended to be in contact with the human body and/or used in an operating unit, such as surgical instruments. These instruments are intended to be sterilized with the basket once the latter has been wrapped in the sterilization sheet F.

As illustrated in FIGS. 12 and 13, the bottom BO is preferably rectangular in shape, the opposite upright sides M1 and M3 corresponding to the long sides, and M2 and M4 to the short sides. The length of the long sides is comprised for example between 200 and 700 mm and that of the short sides between 200 and 500 mm. The height of the upright sides M1 to M4 is comprised for example between 15 and 400 mm.

The edge corners formed where the upright sides M1 to M4 meet are referenced A12, A23, A34 and A41. The free edges of the upright sides M1 to M4 are referenced A1 to A4 respectively.

The weight of the sterilization basket B with the instruments inside may be less than 16 kg, better still less than 14 kg. Sterilization baskets B do not have a lid.

The basket B is placed on the turntable 10, preferably in the center of the latter, for example with the long side of the basket B oriented parallel to the truncated front corner 12 of the table 11, namely, in the frame of reference XYZ associated with the chassis 2, with its long side parallel to the axis X.

In that configuration, the straight line joining the opposite corners F1 and F3 of the sheet F is perpendicular to the long sides of the basket B.

It may be seen in FIG. 10B that the sheet F, because of its dimensions and its position on the table 11, has a first corner F1 which overhangs the truncated front corner 12.

The gripping tool 110 is brought in front of the truncated corner 12 so that it can, as illustrated in FIG. 10B, grasp hold of the first corner F1 of the sheet F. During this operation, the folding tool 20 is inactive.

In order to grasp hold of the first corner F1 of the sheet F, the frame 112 of the gripping tool 110 is positioned in such a way that it surrounds the corner F1 and so that the tip of that corner extends above the profile section 112*a*, under the shoe 15. Thus, when the shoe is lowered and pressed firmly against the upper face of the profile section 112*a*, the corner F1 is gripped between the boss 115*a* and the groove 112*b*, thus holding it.

The first corner F1 thus held can then be brought rearward through the movement of the gripping tool 110 toward an opposite corner F3 of the sheet F, as illustrated in FIG. 10E.

The sheet F is thus folded over the opening of the basket, as illustrated in FIG. 10E. A first fold is obtained.

The corner F1 can then be released by the gripping tool 110, then the plate 114 can be moved forward so as to push the corner F1 under the basket B, as illustrated in FIG. 10F.

To help the gripping tool 110 to slip the corner F1 of the sheet F under the basket B, the fingers 15*a* and 15*b* can be actuated to bring them into the deployed position so that they lift up the central part of the sheet F situated under the basket B. That allows the corner F1 of the sheet F to pass under the upright side M3 of the basket B, assisted by the plate 114 of the gripping tool 110. This then achieves a first tucked flap R1, as illustrated in FIG. 14.

This first tucked flap R1 is situated, in the view of FIG. 10G, on the right-hand side of the basket, under the upright side M3.

The folding tool can then be retracted and the fingers 15*a* and 15*b* lowered so that they return to their retracted initial position.

Once this first tucked flap R1 has been produced, it is possible, as illustrated in FIG. 10H, to make the turntable 10 rotate through 90° in the clockwise direction, moving with it the sheet F and the basket B placed on top, and bringing a corner F2 of the sheet F so that it overhangs the truncated front corner 12 of the table 11, as illustrated in FIG. 10H.

This corner F2 may be grasped by the gripping tool 110.

The lateral parts 22 of the folding tool 20 are used with, in a first phase, the plates 29 in the raised position, as illustrated in FIG. 10, in order with the plates 28 to smooth a portion F6 of the sheet F against the upright side M2 of the basket B. Once this smoothing down operation has been performed, the plates 29 are pivoted downward, as illustrated in FIG. 10J. In its pivoting movement, the plate 29 of the lateral part 22 of the folding tool 20 situated to the left in FIG. 10J takes with it a portion F7 of the sheet F and forms an inward fold against the upright side M2 of the basket B. In FIG. 10J, to make it easier to visualize the operations performed by the folding tool 20, the holding tool 110 has not been depicted in its position in which it grasps hold of the corner F2 of the sterilization sheet F.

The gripping tool 110 is then moved to bring with it the corner F2, so that it covers the basket B, this movement being performed at the same time as the folding tool 20 is withdrawn, so as to allow the corner F2 to pass over the top of the basket. This yields the configuration as illustrated in FIG. 10K. A second fold is thus formed.

FIG. 10K depicts the basket B once this second fold has been made.

Next, as illustrated in FIG. 10L, the turntable 10 is rotated through 180° in the clockwise direction to bring the corner F4, which is the corner opposite the corner F2, so that it overhangs the truncated front corner 12 of the table 11.

The gripping tool 110 is positioned in such a way as to be able to grasp hold of this corner F4.

In the same way as before, the folding tool 20 is brought forward of the upright side M4 opposite the upright side M2, as illustrated in FIG. 10M, and the folding sequence described hereinabove with reference to FIGS. 10I and 10J is repeated, to form a third fold.

FIG. 10N depicts the basket once this third fold has been formed.

Next, as illustrated in FIG. 10O, the turntable 10 is rotated through 90° in the counterclockwise direction or through 270° in the clockwise direction so as to bring the last corner F3 of the sheet F to overhang the front corner 12 of the table 11. This then yields a configuration, once this corner F3 has been gripped by the gripping tool 110, as illustrated in FIG. 10P.

The folding tool 20 is then used to employ the plates 28 to smooth the portions F8 of the sheet F against the upright side M3. During this operation, the plates 29 are in the raised position, as illustrated in FIG. 10P. Once this smoothing over operation has been performed, the plates 29 are pivoted downward, so that they carry with them in their movement portions F9 of the sheet F and form inward folds against the upright side M3, as illustrated in FIG. 10Q. In FIG. 10Q, to make it easier to visualize the operations performed by the folding tool 20, the gripping tool 110 has not been depicted in its position in which it grasps hold of the corner F3 of the sterilization sheet F.

Next, the gripping tool 110 is moved so that it brings the corner F3 of the sheet F over the top of the basket B and forms a fourth fold, as illustrated in FIG. 10R. At the same time as this movement, the folding tool 20 is retracted.

As illustrated in FIG. 17, after the fourth fold has been formed, two portions F5 of the sterilization sheet F are delimited. These portions F5 are situated on the top of the sterilization basket B along the edge corners A2 and A4. These portions F5 are not covered by the sterilization sheet F during the formation of the fourth fold, i.e. when the corner F3 of the sheet F is brought over the top of the basket B. The width of each of the portions F5 at the edge corner A1 is R/2 mm (where R=the value of non-overlap). The value of R is chosen in such a way as to facilitate the operation of the grippers 50. For example, a value of R=116 mm may be chosen, meaning that the width of each of the portions F5 at the edge corner A1 is R/2=58 mm.

Next, as illustrated in FIG. 10S, the folding tool 20 is brought over the basket and the holding panels 70 are actuated to grip the basket B between them. The holding panels 70 press, as illustrated in FIG. 10T, against the lateral upright sides M3 and M4 of the basket.

The grippers 50 are then pivoted inward, as illustrated in FIG. 9, so that the feet 55 of the support 51 slip under the portions F5 of the packaging that are covering the top of the basket B. Next, the actuators 53 are actuated to lower the press rollers 54 and thus grip these portions of the packaging which extend above the feet 55.

The folding tool 20 is then actuated in such a way as to lift the portions F5 thus grasped slightly.

The grippers 50 may pivot away from one another so as to hold the portions F5 extending between them taut. The situation then becomes one in which there are portions F5 held taut between the grippers 50 and lifted up slightly in comparison with the rest of the basket B, creating an opening into which the plate 114 can be introduced, so as to push the final corner F3 of the sheet F into this opening. This yields a second tucked flap R2, as illustrated in FIG. 15. That figure illustrates the possibility that the portions F5 of the packaging may be formed by several superposed thicknesses of the sheet F, as a result of the earlier folding operations.

Next, the press rollers 54 can be raised in order to release the sheet F and the grippers 50 pivoted outward, as illustrated in FIG. 8, to disengage the feet 55.

The tools 110 and 20 can then be moved away from the packaged basket, the holding panels 70 moving apart in order to release it.

The basket can then be recovered from the table 11 by any suitable means, for example by a human operator H as illustrated in FIG. 10U or by any suitable automaton or conveyor.

The machine 1 can be used for wrapping sterilization baskets sequentially in a double wrap, made up for example of two sterilization sheets. The basket that is to be packaged is then placed on two superposed sterilization sheets and the operating sequence of the machine 1 described hereinabove for packaging a sterilization basket with a sterilization sheet is repeated twice. During the packaging of the basket with the first sterilization sheet, the gripping too, using a suction effect, is able to separate the first and second sterilization sheets, thereby allowing only the first sheet to be grasped by the gripping tool.

As an alternative, the machine 1 is used to wrap sterilization baskets in double wrap packaging in a single operation, using for example two sterilization sheets joined together, the two sterilization sheets being joined together at one or more connection sites.

In another variant, the machine is used for packaging an object, notably a sterilization basket, using a folding technique other than the Pasteur folding technique, such as the envelope, square, American folding technique or any other folding technique described in standard ANSI/AAMI ST79: 2010/A4: 2013.

The invention is not restricted to the example which has just been described. For example, in a variant, the two lateral parts 22 of the folding tool 20 move independently of one another along the axis X.

In a variant, the machine 1 is used to package sterilization baskets with lid.

The machine 1 may also be used for packaging ancillaries characterized by shallow rims, or even by the absence of rims.

The term "comprising" is to be understood with its common accepted meaning, namely as being synonymous with "comprising at least one" unless specified to the contrary.

The invention claimed is:

1. A machine for packaging an object with a sterilization packaging material, the machine comprising:

a plate configured to receive the sterilization packaging material and the object to be packaged placed on top; and a gripping tool configured to grasp hold of a corner of the sterilization packaging material, the gripping tool and the plate being able to move relative to one another so as to allow the gripping tool to bring the corner over the top of the object and thus form a fold covering the object;

wherein the plate is configured to rotate relative to the gripping tool about a vertical axis of rotation and the plate comprises a finger that is able to move vertically and is able to lift the object and the sterilization packaging material.

2. The machine as claimed in claim 1, wherein the gripping tool is configured to move vertically and along a horizontal axis.

3. The machine as claimed in claim 1, wherein the gripping tool comprises a shoe configured to move vertically and press against a bearing surface.

4. The machine as claimed in claim 1, wherein the gripping tool has a surface including an orifice selectively connected to a source of vacuum.

5. The machine as claimed in claim 1, wherein the gripping tool comprises a shoe configured to move vertically to press against a bearing surface, the gripping tool having a surface including an orifice selectively connected to a source of vacuum, wherein the orifice opens onto an underside face of the shoe.

6. The machine as claimed in claim 1, wherein the gripping tool comprises a plate configured to push the sterilization packaging material under the object.

7. The machine as claimed in claim 6, wherein the plate is horizontally mounted at the lower end of the gripping tool.

8. The machine as claimed in claim 1, further comprising a table extending around the plate, the table comprising a truncated corner.

9. The machine as claimed in claim 1, further comprising a folding tool configured to move relative to the plate, wherein the folding tool is configured to act on the sterilization packaging material when a fold is formed along one side of the object, by using a smoothing-down member to smooth the sterilization packaging material down along an adjacent side of the object, near the side along which the fold has been formed and around which the next fold is to be made.

10. The machine as claimed in claim 9, wherein the folding tool comprises a pushing member configured to push inward a portion of the sterilization packaging material that extends along the fold, facing the portion of the sterilization packaging material that has been smoothed down against the object.

11. The machine as claimed in claim 10, wherein the smoothing-down member comprises a fixed vertical plate, and the pushing member comprises a vertical plate configured to move about a horizontal axis of rotation.

12. The machine as claimed in claim 10, wherein the folding tool comprises two lateral parts, each of the lateral parts comprising a U-shaped frame, with a front profile section bearing the pushing member and a rear profile section bearing one of the grippers.

13. The machine as claimed in claim 12, wherein:

each of the lateral parts comprises an intermediate profile section; and pivoting panels are mounted on the folding tool, and each of the pivoting panels is articulated between the intermediate profile section and the rear profile section.

14. The machine as claimed in claim 1, further comprising grippers configured to grasp and lift the sterilization packaging material such that a corner of the sterilization packaging material can be pushed under the lifted sterilization packaging material.

15. The machine as claimed in claim 14, wherein the grippers are configured to move away from one another and keep the grasped sterilization packaging material taut.

16. The machine as claimed in claim 14, further comprising:

a folding tool configured to move relative to the plate, wherein the folding tool is configured to act on the sterilization packaging material when a fold is formed along one side of the object, by using a smoothing-down member to smooth the sterilization packaging material down along an adjacent side of the object, near the side along which the fold has been formed and around which the next fold is to be made;

wherein the grippers are configured to pivot on the folding tool.

17. The machine as claimed in claim 1, further comprising mobile holding members configured to laterally hold the object.

18. The machine as claimed in claim 17, wherein the mobile holding members comprise two pivoting panels mounted on the folding tool.

19. The machine as claimed in claim 1, the object being a sterilization basket and/or the sterilization packaging material being a sterilization sheet.

20. A packaging method comprising packaging an object with a sterilization packaging material using a machine;

wherein the machine comprises:

a plate configured to receive the sterilization packaging material and the object to be packaged placed on top; and a gripping tool configured to grasp hold of a corner of the sterilization packaging material, the gripping tool and the plate being able to move relative to one another so as to allow the gripping tool to bring the corner over the top of the object and thus form a fold covering the object;

wherein the plate is configured to rotate relative to the gripping tool about a vertical axis of rotation;

wherein at least four folds are formed by successively grasping hold of one corner of the sterilization packaging material using the gripping tool and by bringing the sterilization packaging material, via this corner, over the object.

21. The packaging method as claimed in claim 20, wherein, between two folds, the sterilization packaging material with the object on top is turned relative to the gripping tool.

22. The packaging method as claimed in claim 20, wherein, after the first fold is formed, the first corner that was grasped in order to make this first fold, is pushed under the object.

23. The packaging method as claimed in claim 20, wherein the sterilization packaging material is held against the object and a fold previously formed is pushed laterally inward.

24. The packaging method as claimed in claim 20, wherein the packaging is performed using two sterilization packaging materials.

25. The packaging method as claimed in claim 24, wherein the packaging is performed with the two sterilization packaging materials sequentially or simultaneously when these two sterilization packaging materials are joined together at one or more connection sites.

26. A machine for packaging an object with a sterilization packaging material, the machine comprising:

a plate configured to receive the sterilization packaging material and the object to be packaged placed on top;

a gripping tool configured to grasp hold of a corner of the sterilization packaging material, the gripping tool and the plate being able to move relative to one another so as to allow the gripping tool to bring the corner over the top of the object and thus form a fold covering the object; and a table extending around the plate, the table comprising a truncated corner, wherein the plate is configured to rotate relative to the gripping tool about a vertical axis of rotation.

27. A machine for packaging an object with a sterilization packaging material, the machine comprising:

a plate configured to receive the sterilization packaging material and the object to be packaged placed on top;

a gripping tool configured to grasp hold of a corner of the sterilization packaging material, the gripping tool and the plate being able to move relative to one another so as to allow the gripping tool to bring the corner over the top of the object and thus form a fold covering the object; and a folding tool configured to move relative to the plate, wherein the folding tool is configured to act on the sterilization packaging material when a fold is formed along one side of the object, by using a smoothing-down member to smooth the sterilization packaging material down along an adjacent side of the object, near the side along which the fold has been formed and around which the next fold is to be made, wherein the plate is configured to rotate relative to the gripping tool about a vertical axis of rotation.

28. A machine for packaging an object with a sterilization packaging material, the machine comprising:

a plate configured to receive the sterilization packaging material and the object to be packaged placed on top;

a gripping tool configured to grasp hold of a corner of the sterilization packaging material, the gripping tool to bring the corner over the top of the object and thus form a fold covering the object; and mobile holding members configured to laterally hold the object, wherein the plate is configured to rotate relative to the gripping tool about a vertical axis of rotation.

* * * * *